US007563554B2

(12) United States Patent
Ueda et al.

(10) Patent No.: US 7,563,554 B2
(45) Date of Patent: Jul. 21, 2009

(54) ELECTROPHOTOGRAPHIC TONER

(75) Inventors: Takamasa Ueda, Tokyo (JP); Mikio Koyama, Tokyo (JP); Kenji Hayashi, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 538 days.

(21) Appl. No.: 11/465,177

(22) Filed: Aug. 17, 2006

(65) Prior Publication Data

US 2007/0099106 A1 May 3, 2007

(30) Foreign Application Priority Data

Nov. 1, 2005 (JP) ..... 2005-318089
Nov. 1, 2005 (JP) ..... 2005-318090

(51) Int. Cl.
*G03G 9/087* (2006.01)

(52) U.S. Cl. ..... 430/137.14

(58) Field of Classification Search ..... 430/137.14
See application file for complete search history.

(56) References Cited

U.S. PATENT DOCUMENTS 5,929,139 A * 7/1999 Mori et al. ..... 523/334

* cited by examiner

*Primary Examiner*—Hoa V Le
(74) *Attorney, Agent, or Firm*—Lucas & Mercanti, LLP

(57) ABSTRACT

A method of preparing an electrophotographic toner is disclosed, comprising subjecting polyester resin particles and colored microparticles to coagulation and fusion in an aqueous medium to form toner particles, wherein the colored microparticles comprise a colorant and a crosslinked polyester resin or a nitrogen-containing polycondensate resin.

20 Claims, 1 Drawing Sheet

ELECTROPHOTOGRAPHIC TONER

TECHNICAL FIELD

The present invention relates to electrophotographic toners.

RELATED ART

To achieve images of high quality in imaging through an image forming method based on an electrophotographic system, a further decrease in toner particle size is required. To meet such needs, there have been manufactured polymeric toners. A polymeric toner is composed of a particulate resin obtained via a polymerization process such as emulsion polymerization, colorant particles and optionally other particles.

The resin particles to obtain a polymerized toner can be prepared by a process of emulsion polymerization in which a polymerizable monomer as a raw material is dispersed in an aqueous medium containing an emulsifying agent to form oil-droplets and radical polymerization is performed upon addition of a polymerization initiator. For instance, styrene/acryl resin particles have been studied as disclosed in JP-A Nos. 2000-214629 and 2001-125313 (hereinafter, the term JP-A refers to Japanese Patent Application Publication).

In such a toner preparation method, the kinds of polymerizable toners usable in radical polymerization are limited so that obtained toners are limited to toner particles composed of vinyl resin particles or acryl resin particles.

Since a toner obtained from a polyester resin which exhibits superior viscoelastic properties results in enhanced fixability, a toner comprised of toner particles obtained by coagulation of polyester resin particles is desired. To obtain a toner containing such polyester resin particles, for example, a toner preparation method is proposed, in which a solution of a polyester resin dissolved in an organic solvent is dispersed in an aqueous medium to form polyester resin particles and subsequently, the formed polyester resin particles are allowed to coagulate together with colorant particles, followed by removal of the solvent to obtain toner particles, as disclosed in JP-A 2004-109848.

Alternatively, there is also a method comprising a polymerization step in which oil-droplets of a polymerization composition including at least a polycarboxylic acid and a polyol are formed in an aqueous medium containing a surfactant having a long chain hydrocarbon group and an acidic group and the polycarboxlic acid and the polyol are polymerized to obtain a particulate polyester resin, followed by a coagulation step in which the obtained polyester resin particles are coagulated together with colorant particles in an aqueous medium.

Recently, in the field of copiers and printers, requirement for enhancement of image quality is increased in the market and the trend for color copying or printing has been increased. To meet the requirement for high image quality, preparation methods of polymerization toner using emulsion polymerization, suspension polymerization or dispersion polymerization which enable preparation of fine particles having a sharp particle size distribution at low cost were proposed, as disclosed in, for example, JP-A Nos. 63-186253, 6-329947, 9-15904 and 8-320594.

Specifically, transparency and color reproducibility are required in toner images used for overhead projectors (OHP).

Toners using pigments as a colorant were also studied, as disclosed in, for example, JP-A Nos. 63-186253, 2-210363, 62-157051, 62-255956 and 6-118715. Toners using dyes as a colorant and those using a mixture of a dye and a pigment are also studied, as disclosed in, for example, JP-A Nos. 5-11504 and 5-34980.

SUMMARY OF THE INVENTION

However, though a toner in which a pigment as a colorant was used as such, exhibits superior light stability, the pigment was insoluble in a resin or a solvent used in the preparation of the toner and toner particles cause secondary and tertiary coagulation, forming particles of several hundreds nm and producing problems that when enlarged in OHP, transparency was lowered, hue of transmitted light changes or discoloration due to heat occurred.

On the other hand, when a dye as such was used in a toner, the dye was dissolved in a binding resin of the toner and existed in the state of monomolecular dispersion, resulting superiority in transparency or in hue change or chroma of transmitted light, compared to pigments but having disadvantages such as deteriorated light stability and low heat resistance. There was also a problem that the dye leached out in a water phase in the course of preparing a polymerized toner.

In light of the foregoing problems, it is an object of the present invention to provide an electrophotographic toner (hereinafter, also denoted simply as a toner) exhibiting enhanced transparency and chroma, and superior light stability by a polyester resin which can achieve low-temperature fixability.

It is also an object of the invention to supply a toner obtained by combining a polyester resin with colored microparticles in which a colorant is contained in a cross-linked polyester resin or a nitrogen-containing polycondensate polymer and the colorant is dispersed without being dissolved in the cross-linked polyester resin or the nitrogen-containing polycondensate polymer, while maintaining a finite particle size, thereby resulting in enhanced light stability, high transparency and improved heat resistance.

Furthermore, it is an object of the invention to provide a toner in which a colorant is tightly bound in cross-linked polyester resin or a nitrogen-containing polycondensate polymer to cause no separation of the colorant from the resin and inhibits dye decomposition in the course of preparing the toner, resulting in toner images of higher densities.

One aspect of the invention is directed to a method of preparing an electrophotographic toner, wherein the toner is obtained by subjecting polyester resin particles and colored microparticles to coagulation and fusion and the colored microparticles each comprise a colorant, and a cross-linked polyester resin or nitrogen-containing polycondensate polymer.

Still, another aspect of the invention is directed to an electrophotographic toner comprising polyester resin as a binder and colored microparticles each comprise a colorant, and a cross-linked polyester resin or nitrogen-containing polycondensate polymer.

DETAILED DESCRIPTION OF THE INVENTION

Figure 1:
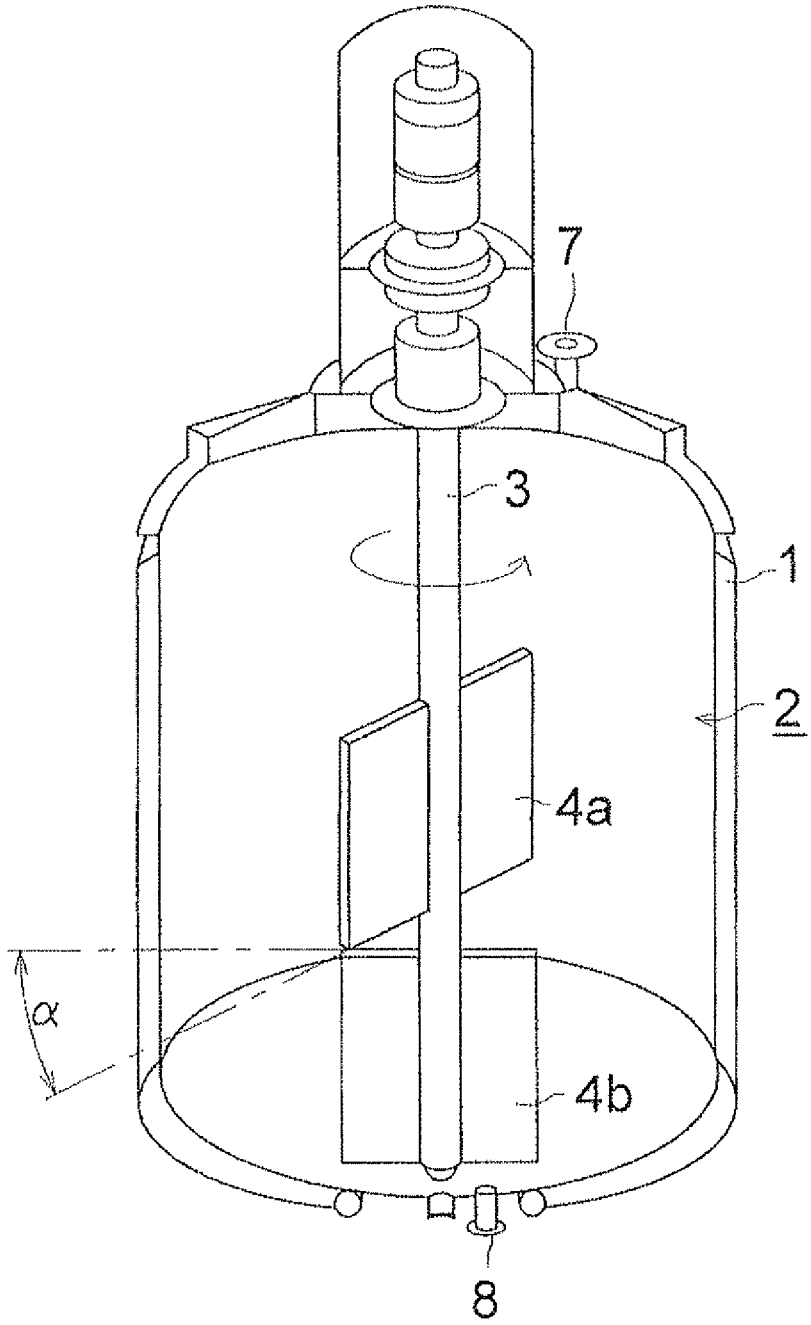
FIG. 1 illustrates a perspective view of a reactor used for preparation of the electrophotographic toner of the invention.

There were made studies with respect to a toner which causes no separation of a colorant and inhibits decomposition of the colorant in the course of preparing the toner, giving toner images exhibiting an enhanced density and superior light stability and transparency.

As a result of extensive study, it was found that the use of polyester resin exhibiting characteristics for low-temperature fixability enabled low-temperature fixing and the foregoing problems were overcome especially by a toner obtained by allowing particles of the polyester resin and colored microparticles comprised of a colorant and a cross-linked polyester resin or a nitrogen-containing polycondensate polymer to coagulate and fuse in an aqueous medium.

As the reason for overcoming the foregoing problems it is assumed that, in the interior of the microparticle containing a colorant and a cross-linked polyester resin or nitrogen-containing polycondensate polymer, the colorant becomes dispersible, while exhibiting a finite particle size without being completely dissolved in the resin and when polyester resin particles and colored microparticles are allowed to coagulate and fuse in an aqueous medium, the colorant is tightly bonded in the cross-linked polyester resin or nitrogen-containing polycondensate polymer, whereby no separation of the colorant is caused while preparing the toner and decomposition of the colorant is also inhibited, resulting in formation of toner images exhibiting enhanced density and superior light stability.

Further, it is assumed that including the colorant in the colored microparticles controls the colorant particle size so as to maintain transparency of the toner image, resulting in enhanced transparent toner images.

The present invention will be described more in detail.

One embodiment of the toner of the invention is a toner including a polyester resin and colored microparticles. The toner is preferably a toner not manufactured by a pulverizing method. The pulverizing method is well known and is a process including melt-keading a resin and necessary ingredients and pulverizing the resultant so as to obtain the toner particles.

Another embodiment, which is preferable, of the toner of the invention is a toner prepared by allowing polyester resin particles and colored microparticles to coagulate and fuse in an aqueous medium to form toner particles.

Methods for preparing toners related to the invention are not specifically limited and include, for example, those disclosed in JP-A Nos. 5-265252, 6-329947 and 9-15904, in which dispersed particles of constituent materials such as resin particles and a colorant are allowed to coalesce. Specifically, after being dispersed in water using surfactants, these particles are coagulated by adding a coagulant at a concentration higher than the critical coagulation concentration to cause salting out and are concurrently fused with heating at a temperature higher than the glass transition temperature of the resin. The thus fused particles are grown, while forming fused particles and when reaching the intended particle size, a large amount of water is added thereto to terminate the particle growth. The particle surface is smoothed with stirring and heating to control the particle shape. The thus formed particles are dried with heating in a fluidized state of containing water to form the targeted toner particles. Herein, a solvent which is infinitely soluble in water, may be added concurrently with the coagulant.

Colored microparticles used in the invention can be obtained in such a manner that a cross-linked polyester resin or nitrogen-containing polycondensate resin and a colorant are dissolved or dispersed in an organic solvent and emulsified in water, and then the organic solvent is removed. Specific examples of an organic solvent include toluene, ethyl acetate, methyl ethyl ketone, acetone, dichloromethane, dichloroethane, and tetrahydrofuran.

The cross-linked polyester resin usable in the invention are preferably chosen from polyester resins comprising polyvalent alcohol units and polyvalent carboxylic acid units including at least one polyvalent carboxylic acid unit having a valence of three or more. In other words, the cross-linked polyester resin are chosen from polyester resins which are formed by polycondensation of polyvalent alcohols and polyvalent carboxylic acids including at least one polyvalent carhoxylic acid having a valence of three or more. Herein, the polyvalent carboxylic acid having a valence of three or more refers to a compound having at least three carboxylic groups in the molecule. In the cross-linked polyester resin, such a polyvalent carboxylic acid unit having a valence of three or more, preferably accounts for 10% to 30% by weight of total polyvalent carboxylic acid units, whereby a colorant is not completely dissolved but is dispersible in the form of particles of finite sizes.

In the invention, a polyurethane, polyurea, polyurethane-polyurea, polyamide or a melamine resin is suitably used as a nitrogen-containing polycondensate resin.

Polyurethane is prepared by polymerizing constituents capable of forming a polyurethane, such as a polyisocyanate constituent (either monomer or prepolymer) and a polyol constituent by employing interfacial polymerization. Coverage resin can be prepared in such a manner that a non-aqueous organic solvent containing a resin constituting the interior of a colored particle, a colorant and a monomer or prepolymer as a raw material of the covering resin, is dispersed in water in the form of oil-droplets to form a covering resin in the interior or the on interface of the oil-droplets. Polyurethane as a coverage resin can be formed by using a first monomer and a second monomer. Examples of polyisocyanate compounds as the first monomer include diisocyanates such as m-phenylenediisocyanate, p-phenylenediisocyanate, 2,6-tolylenediisocyanate, 2,4-tolylenediisocyanate, naphthalene-1,4-diisocyanate, diphenylmethane-4,4'-diisocyanate, isophoronediisocyanate, 3,3'-dimethoxy-4,4'-biphenyl-diisocyanate, 3,3'-dimethylphenylmethane-4,4'-diisocyanate, xylilene-1,4-diisocyanate, 4,4'-diphenylpropanediisocyanate, trimethylenediisocyanate, hexamethylenediisocyanate, propylene-1,2-diisocyanate, butylenes-1,2-diisocyanate, cyclohexylene-1,2-diisocyanate, cyclohexylene-1,4-diisocyanate; polyisocyanates such as tolyene2,4,6-triisocyanate, 4,4'-dimethyldipenylmethane-2,2',5,5'-tetrisocyanate; and isocyanate prepolymer such as adduct of hexamethylenediisocyanate and trimethylolpropane, adduct of 2,4-tolylenediisocyanate and trimethylolpropane and adduct of tolylenediisocyanate and hexanetriol. Examples of a polyol compound as the foregoing second monomer include aliphatic polyhydric alcohols such as ethylene glycol, 1,3-propanediol, 1,4-butanediol, 1,5-pentanediol, 1,6-hexanadiol, 1,7-heptanediol, 1,8-octanediol, propylene glycol, 2,3-dihydroxybutane, 1,2-dihydroxybutane, 2,2-dimethyl-1,3-dihydroxybutane, 2,2-dimethyl-1,3-propanediol, 2,4-pentanediol, 2,5-hexanediol, 3-methyl-1,5-pentanediol, 1,4-cyclohexanedimethanol, dihydroxycyclohexane, diethylene glycol, 1,2,6-trihydroxyhexane, 2-phenylpropylene glycol, 1,1,1-trimethylolpropane, hexanetriol, pentaerythritol, pentaerythritol ethylene oxide adduct, and glycerin; aromatic polyhydric alcohols such as 1,4-di(2-hydroxyethoxy)benzene and resorcinol dihydroxyethyl ether; an adduct of alkylene oxide, p-xylylene glycol, m-xylylene glycol, bisphenol A ethylene oxide adduct and bisphenol A propylene oxide adduct. The amount of an isocyanate compound added to the oil phase is preferably from 0.005% to 0.5% by weight, based on the total weight of constituents resin and colorant, and more preferably from 0.01% to 0.3% by weight. The amount of a polyol compound to e be added is preferably 0.02 to 2 mol of hydroxyl group per mol of isocyanate group of a polyisocyanate compound. In the case of a polyurethane resin, a resin and a colorant constituting a colored microparticle and polyisocyanate and polyol compounds are preferably dissolved or dispersed in an organic solvent such as ethyl acetate or butyl acetate to form an oil phase. When using a prepolymer as a polyisocyanate compound, the step of using a polyol compound may be omitted.

A polyol compound can be added to the water phase. In that case, it is desirable to use a lower polyol readily soluble in the water phase, as a polyol component or to adjust the water phase toward alkalinity side so that a polyol is more easily soluble in the water phase.

In the case of a polyurea, an aliphatic diamine such as ethylenediamine, trimethylenediamine, tetramethylenediamine, pentamethylenediamine or hexamethylenediamine; an aromatic diamine such as p-phenylenediamine, m-phenylendiamine, piperazine, 2-methylpiperazine or 2,5-dimethylpiperazine; and a polyamine such as 2-hydroxytrimethylenediamine, diethylenetriaminediethylaminopropylamine or tetraethylenepentamine are usable in place of a polyol component of polyurethane described above. A covering resin of polyurethane/polyurea can be formed by using a polyol and polyamine in combination. A shell of polyurea and polyurethane/polyurea can be formed in accordance with the formation of the polyurethane shell described above.

A polyamide can be formed by using an acid halide and a polyamine in combination. Examples of an acid halide include succinoyl chloride, adipoyl chloride, fumaroyl chloride, phthaloyl chloride, terephthaloyl chloride, 1,4-cyclohexanedicarbonyl chloride; and Examples of a polyamine include ethylenediamine, tetramethylenediamine, hexamethylenediamine, phenylenediamine, diethyleneriamine, triethylenetetramine, tetraethylenepentamine, diethylaminopropypylamine, piperazine, 2-methylpiperazine and 2,5-dimethylpiperazine.

Melamine resins include a resin composed of a condensate of a compound having a triazine skeleton and an aldehyde Examples of a compound having a triazine skeleton include melamine and benzoguanamine. Of these, melamine is preferred. Examples of an aldehyde include formaldehyde, acetaldehyde, propionealdehyde and glyoxal. Of these, formaldehyde is preferred.

Colorants usable in the invention include commonly known dyes and pigments. Of these, dyes are preferred, and oil-soluble dyes and chelate dyes are more preferred.

Specifically, an oil-soluble dye exhibiting a solubility in toluene of not less than 0.01 g/100 ml, that is, at least 0.01 g per 100 ml of toluene is preferred in the invention. The solubility of a dye is determined in such a manner that the dye is added to 100 ml of toluene at a temperature (25° C.), stirred and filtered after being allowed to stand for 24 hr. Toluene is distilled off from the solution to determine the weight of the dye contained in the solution. Solubility in water of the dye is determined similarly.

Specific examples of dyes are as follows: yellow dyes include C.I. Solvent Yellow 2 (2.4), the said 3 (3.6), the said 5 (5.7), the said 7 (1.6), the said 8 (2.0), the said 16 (7.1), the said 17 (1.0), the said 24 (0.4), the said 30 (3.0), the said 31 (2.0), the said 35 (5.0), the said 44 (0.01), the said 88 (0.8), the said 89 (5.0), the said 98 (2.0), the said 102 (0.7), the said 103 (1.3), the said 104 (0.11), the said 105 (0.18), the said 111 (0.23), the said 114 (0.09), the said 162 (40.0) and C.I. Disperse Yellow 160 (0.02); magenta dyes include C.I. Solvent Red 3 (0.7), the said 14 (0.03), the said 17 (1.0), the said 18 (0.8), the said 22 (3.0), the said 23 (1.4), the said 51 (1.4), the said 53 (0.1), the said 87 (0.2), the said 127 (0.3), the said 128 (1.2), the said 131 (0.2), the said 145 (0.2), the said 146 (1.1), the said 149 (0.19), the said 150 (0.07), the said 151 (0.2), the said 152 (0.89), the said 153 (0.8), the said 154 (0.2), the said 155 (0.05), the said 156 (0.5), the said 157 (0.6), the said 158 (0.9), the said 176 (0.05) and the said 179 (0.37), and C.I. Solvent Orange 63 (0.02), the said 68 (0.70), the said 71 (0.11), the said 72 (4.9) and the said 78 (0.33); cyan dyes include C.I. Solvent Blue 4 (0.5), the said 8 (0.1), the said 19 (0.1), the said 21 (0.1), the said 22 (2.0), the said 50 (1.0), 55 (5.0), 63 (0.6), 78 (0.12), the said 82 (0.4), the said 83 (1.8), the said 84 (2.8), the said 85 (0.2), the said 86 (0.9), the said 90 (0.45), the said 91 (1.0), the said 92 (0.02), the said 93 (0.1), the said 94 (0.12), the said 95 (4.7), the said 97 (12.5) and the said 104 (50). In the foregoing, numerals in parentheses indicate solubility in toluene. These dyes exhibit solubility in water of not more than 1% by weight, that is, not more than 1 g per 100 g of water. These dyes are added in an amount of 1% to 10% by weight, based on the resin used in the toner.

A chelate dye refers to a compound in which dyes coordinate to a metal ion at two- or more dentate coordination, provided that a ligand other than dyes may be coordinated. In the invention, the ligand refers to an atom or atomic group capable of coordinating to a metal ion, which may be electrically charged or not.

Metal chelate dyes usable in the invention are those represented by the following formula (1):

$$M(Dye)_n(A)_m \qquad \text{formula (1)}$$

wherein M represents a metal ion, "Dye" represents a dye capable of coordinating to the metal ion, A represents a ligand other than the dye, n is an integer of 1, 2 and 3, and m is an integer of 0, 1, 2 and 3, provided that when m is 0, n is 2 or 3 and plural "Dye"s may be the same or different. Metal ions represented by M include ions of metals of Groups 1 to 8 of the periodical table, for example, ions of Al, Co, Cr, Cu, Fe, Mn, Mo, Ni, Sn, Ti, Pt, Pd, Zr and Zn. Of these metal ions, ions of Ni, Cu, Cr, Co, Zn and Fe are preferred in terms of color and various types of durability. Preferred metal chelate dyes are disclosed in JP-A Nos. 9-277693, 10-20559 and 10-30061. Specific examples of dyes capable of forming metal chelate dyes are shown below.

D-1

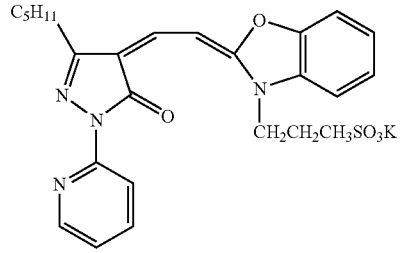

D-2

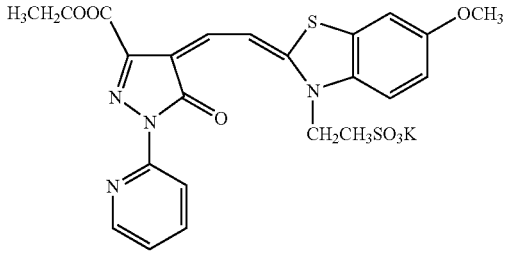

-continued
D-3
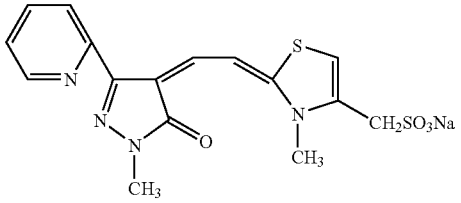
D-4
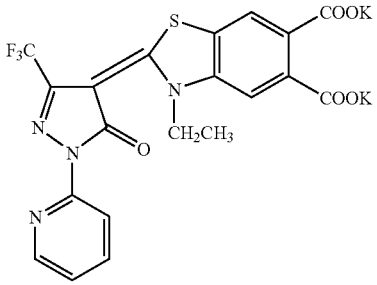
D-5
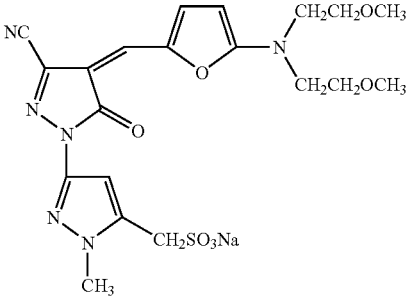
D-6
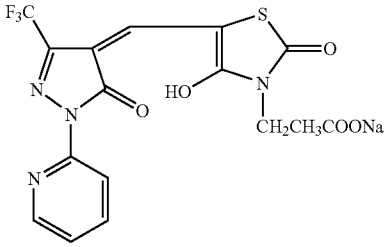
D-7
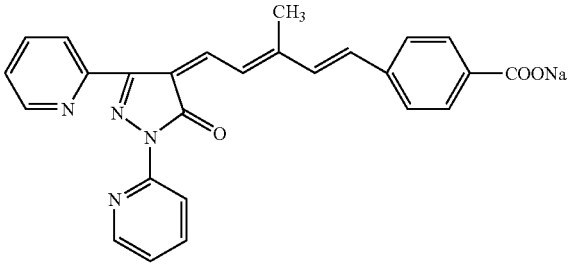
D-8
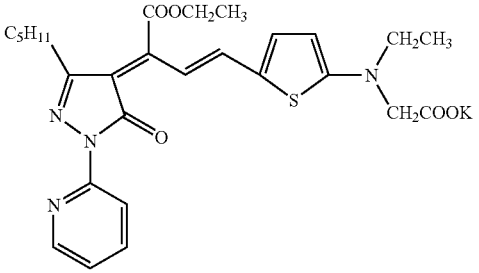
-continued
D-9
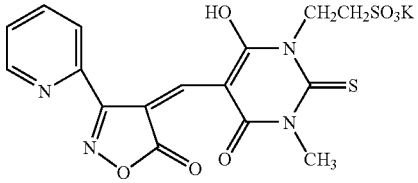
D-10
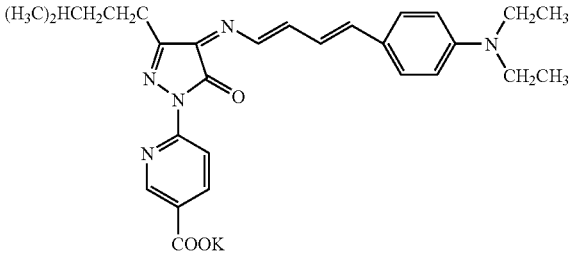
D-11
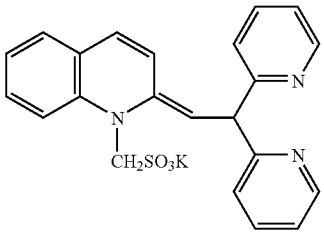
D-12
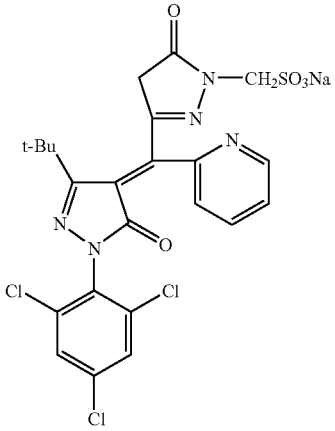
D-13
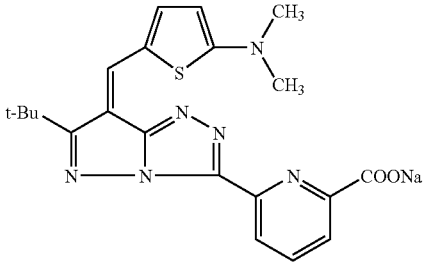

-continued
D-14
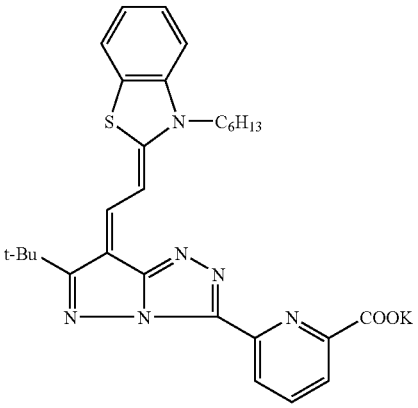
D-15
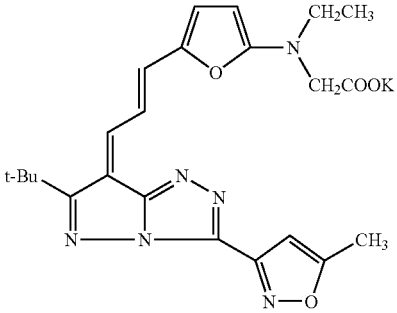
D-16
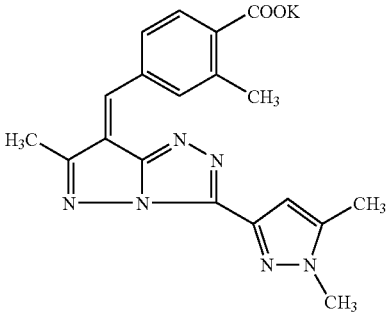
D-17
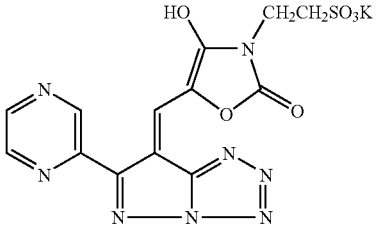
D-18
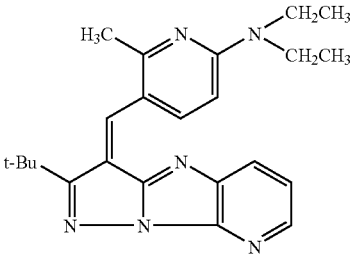
-continued
D-19
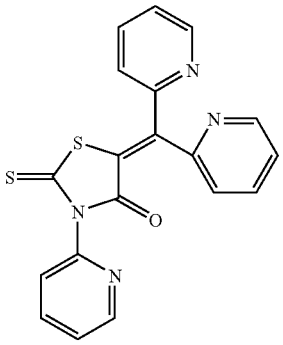
D-20
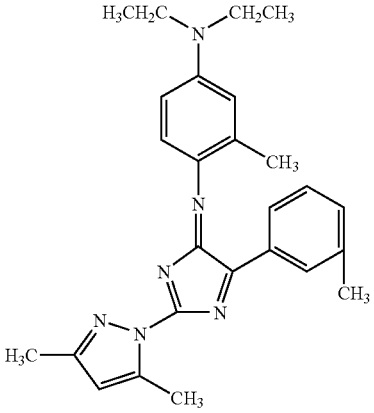
D-21
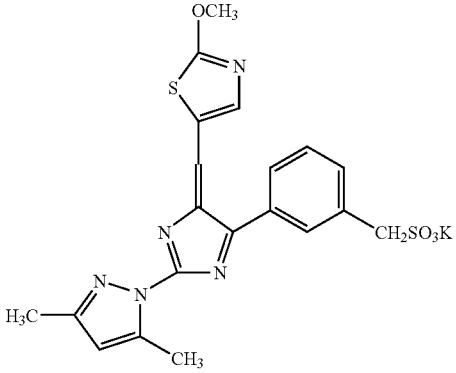
D-22
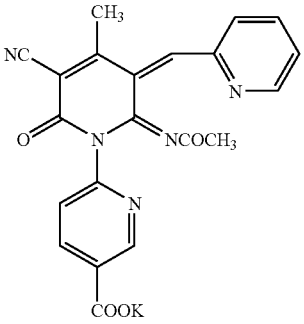

-continued
D-23
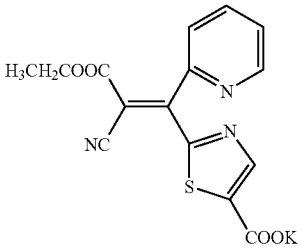
D-24
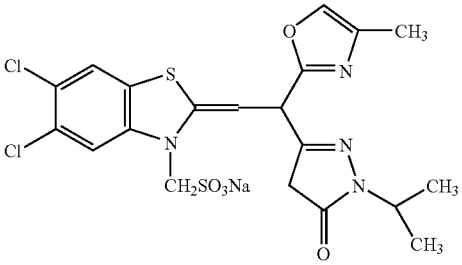
D-25
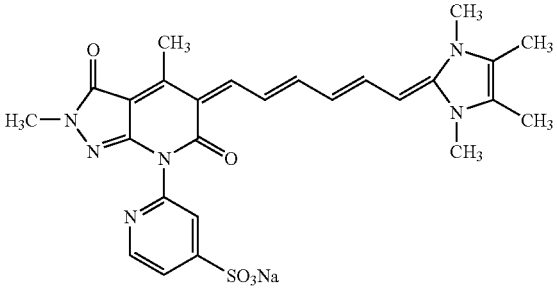
D-26
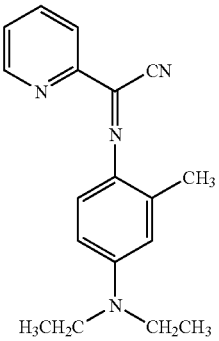
D-27
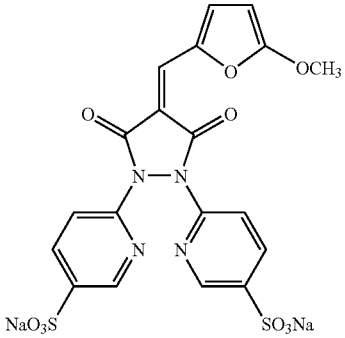
-continued
D-28
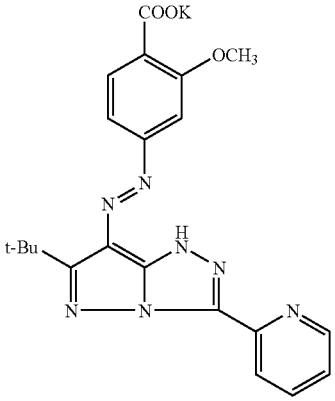
D-29
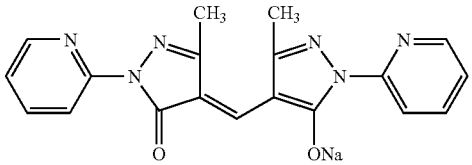
D-30
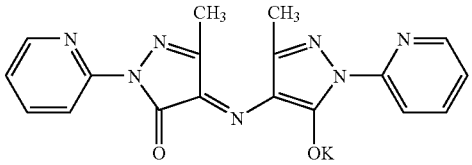
D-31
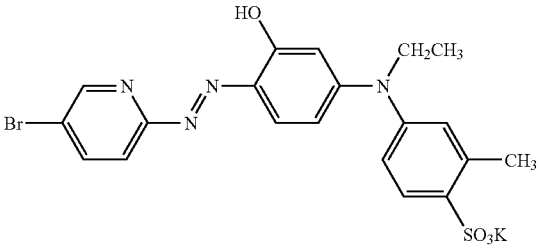
D-32
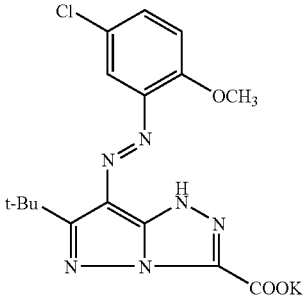
D-33
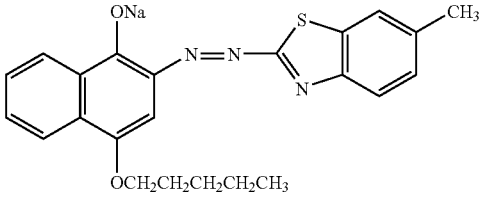

-continued
D-34
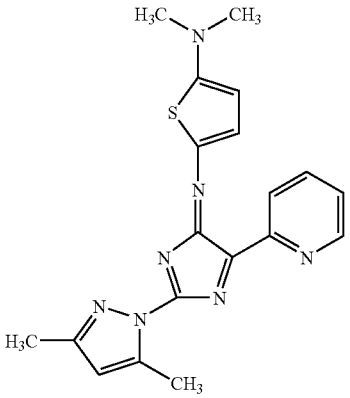
D-35
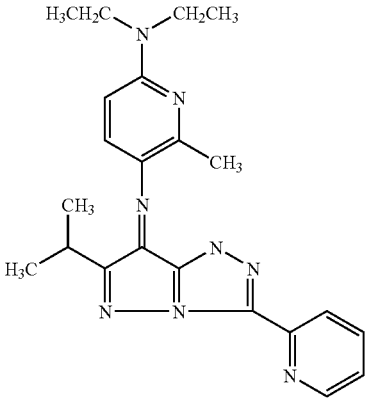
D-37
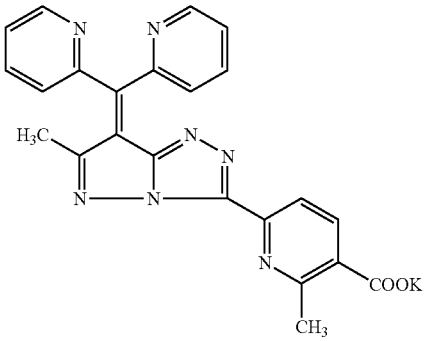
D-38
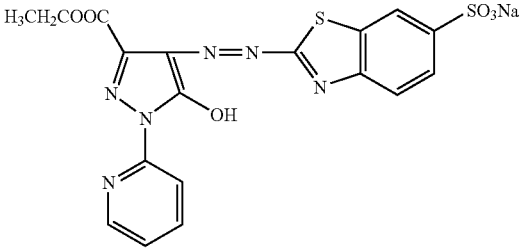
-continued
D-39
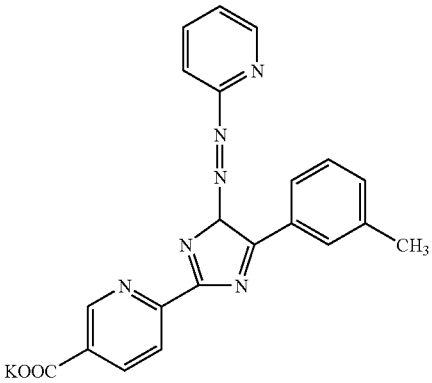
D-40
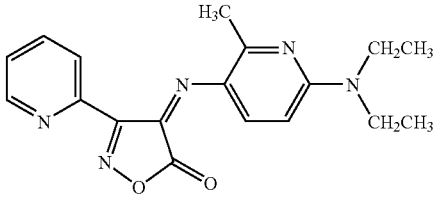
D-41
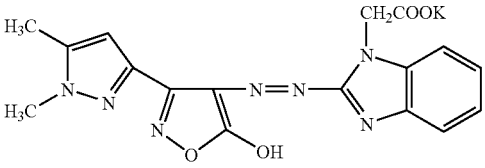
D-42
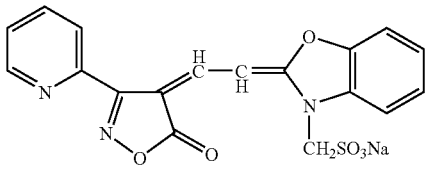

-continued
D-43
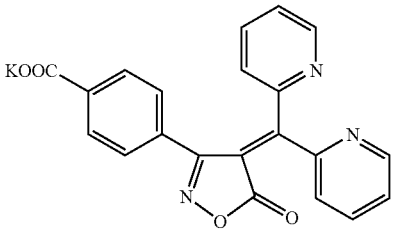
D-44
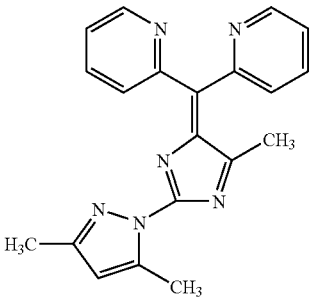
-continued
D-45
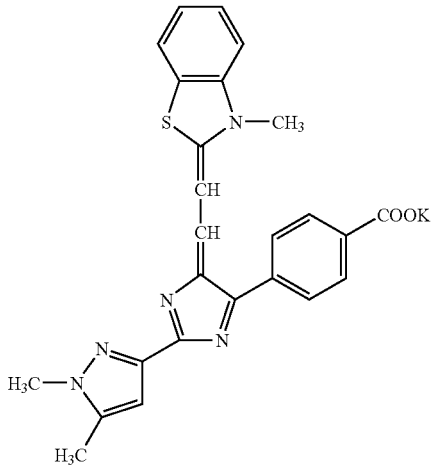
Further, specific examples of metal chelate dyes are shown below.
D-1
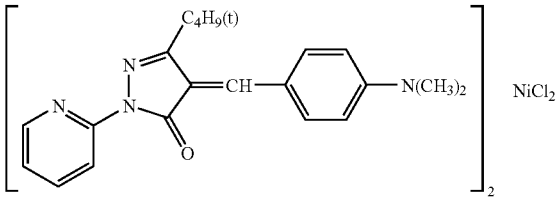
D-2
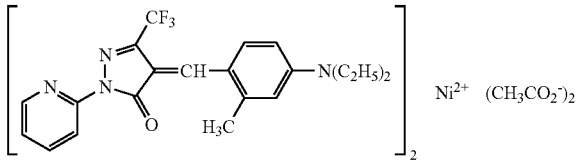
D-3
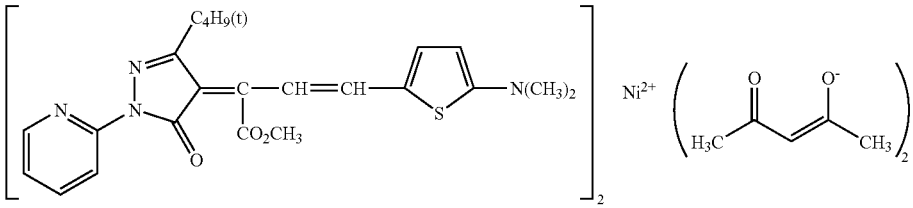
D-4
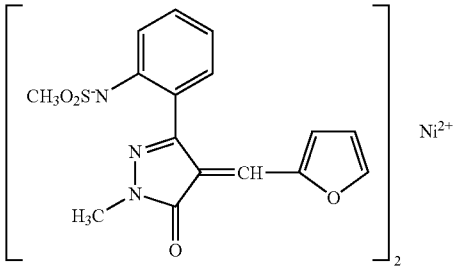
D-5
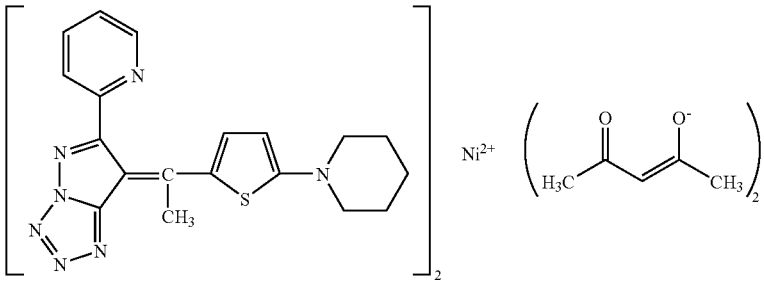

-continued
D-6
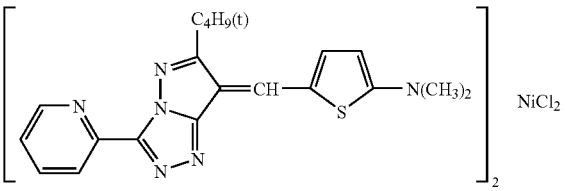
D-7
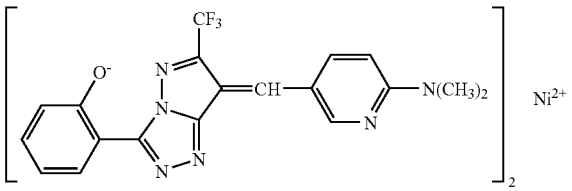
D-8
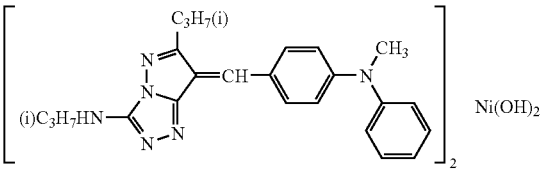
D-9
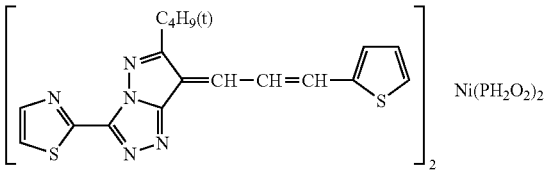
D-10
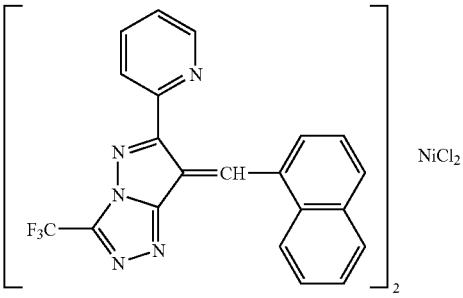
D-11
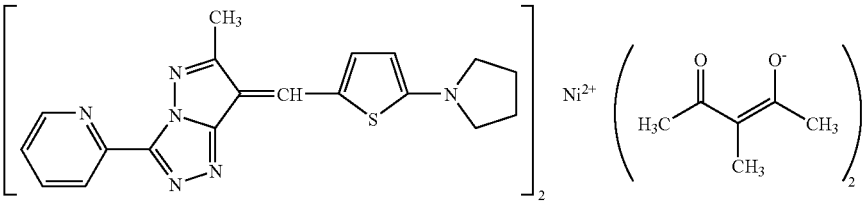
D-12
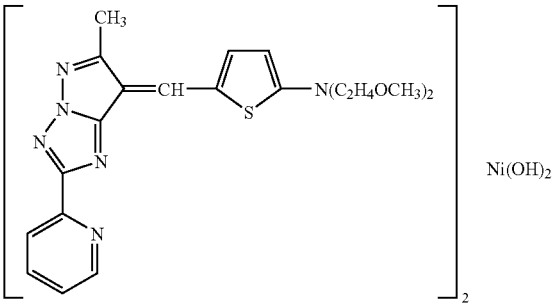
D-13
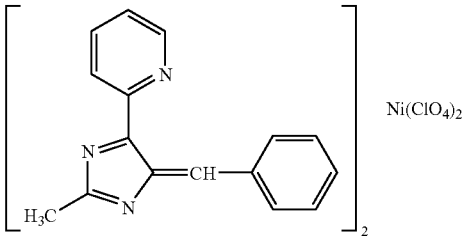

-continued
D-14
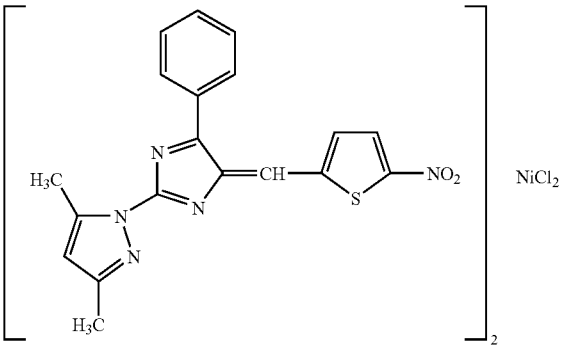
$NiCl_2$
D-15
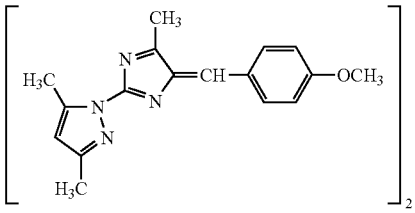
$Ni^{2+}(CH_3COO^-)_2$
D-16
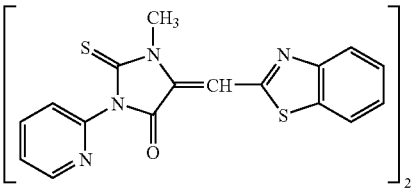
$Ni^{2+}(C_6H_5COO^-)_2$
D-17
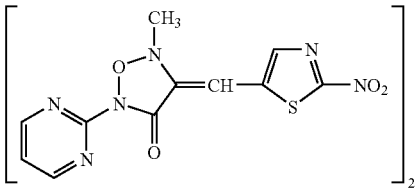
$Ni^{2+}(C_6H_5COO^-)_2$
D-18
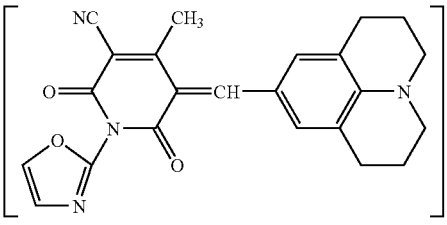
$NiCl_2$
D-19
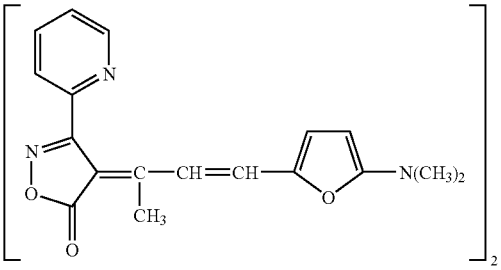
$Ni^{2+}$
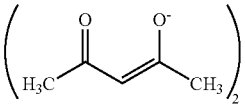
D-20
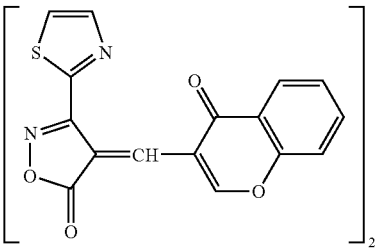
$Ni(ClO_4)_2$
D-21
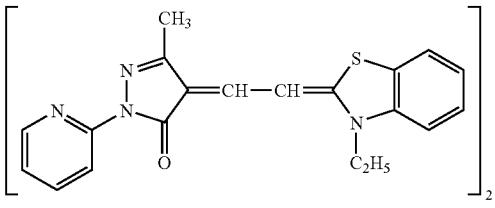
$NiCl_2$
D-22
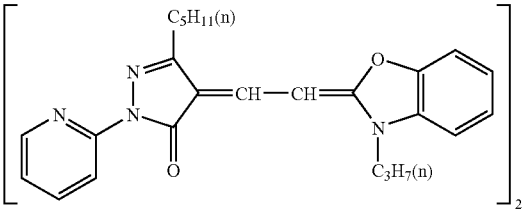
$Ni^{2+}$
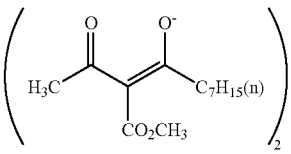

-continued
D-23
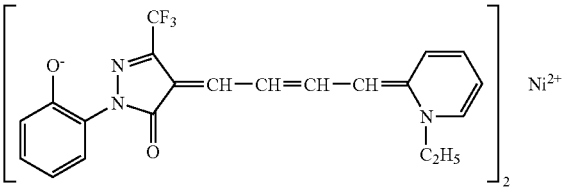
D-24
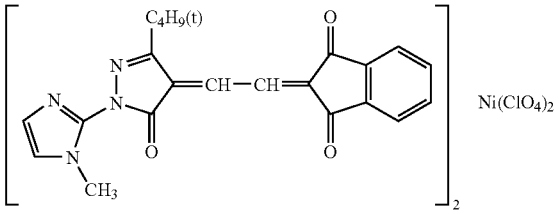
D-25
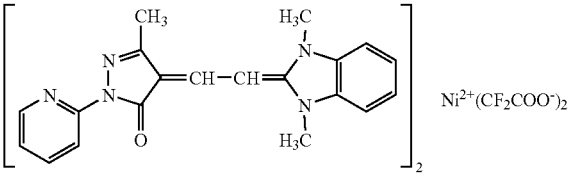
D-26
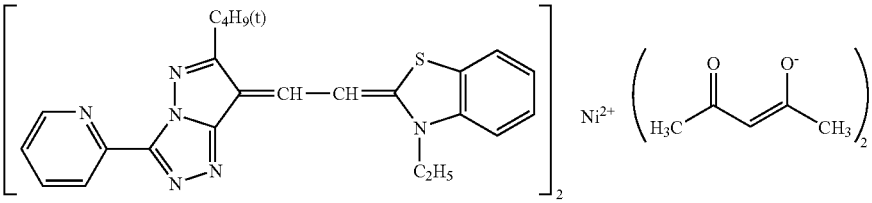
D-27
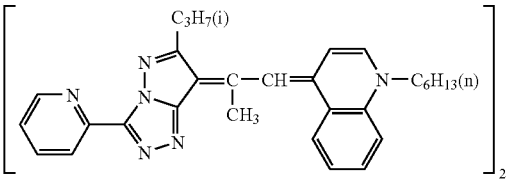
D-28
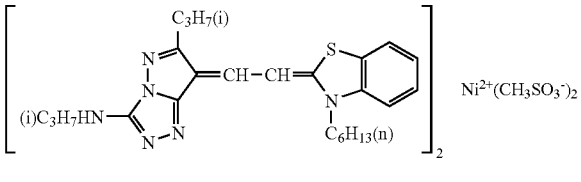
D-29
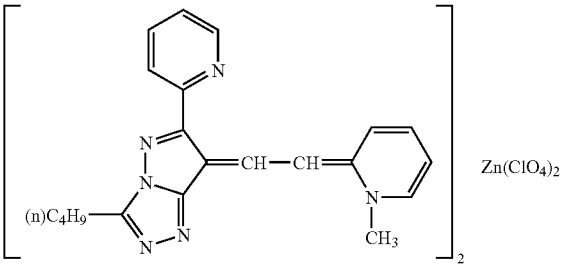
D-30
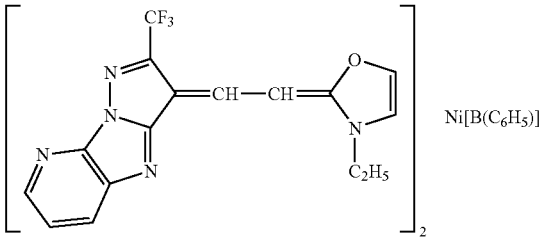
D-31
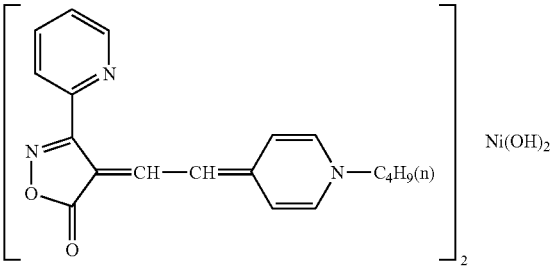
D-32
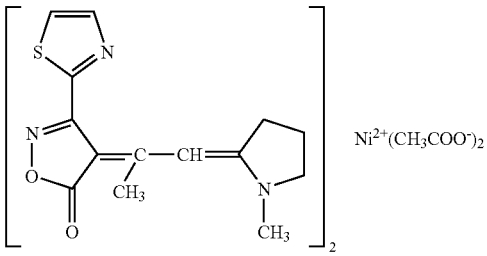

-continued
D-33
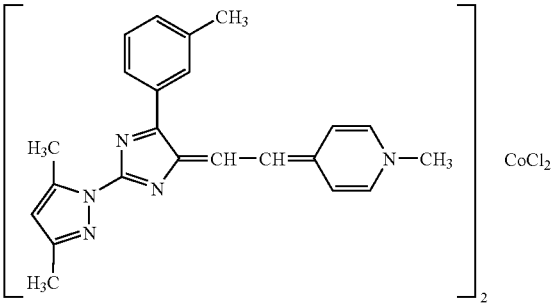
$CoCl_2$
D-34
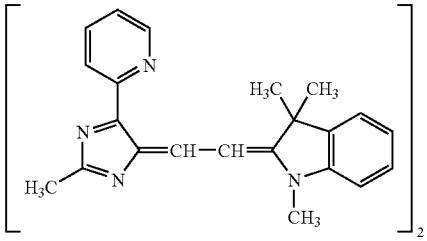
$Ni^{2+}(C_6H_5SO_3^-)_2$
D-35
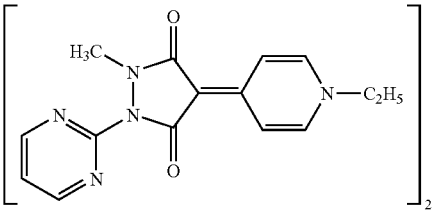
$NiI_2$
D-36
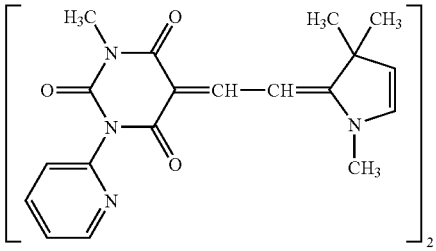
$Ni(ClO_4)_2$
D-37
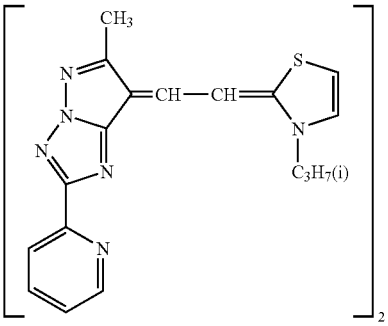
$NiCO_2$
D-38
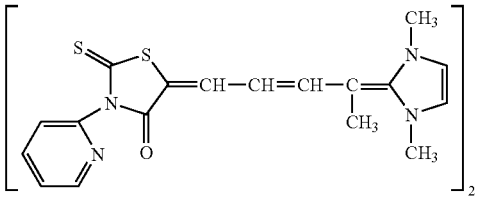
$NiCl_2$
D-39
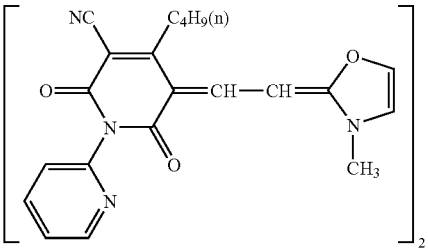
$NiBr_2$
D-40
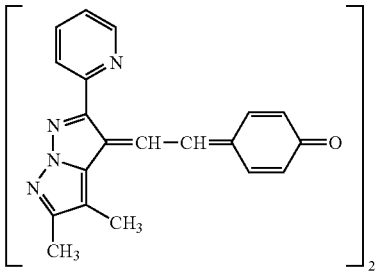
$Ni^{2+}(n\text{-}C_6H_{13}COO^-)_2$
D-41
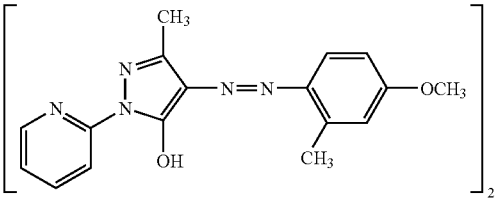
$NiBr_2$
D-42
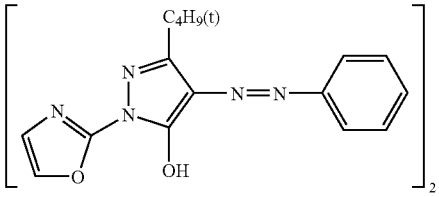
$CuCl_2$ -continued
D-43
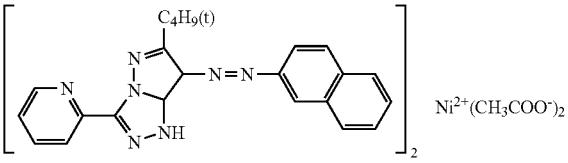
D-44
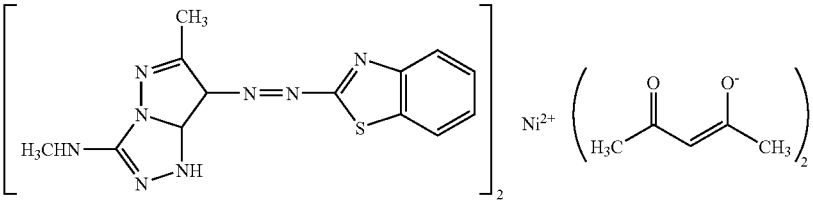
D-45
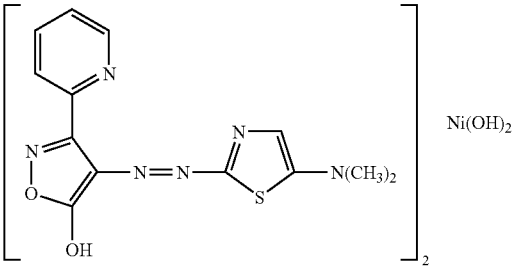
D-46
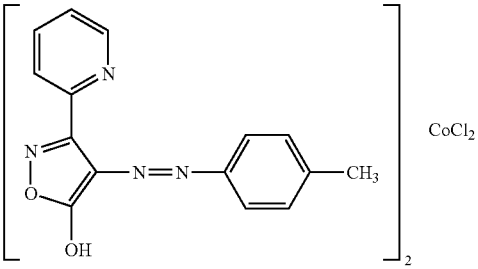
D-47
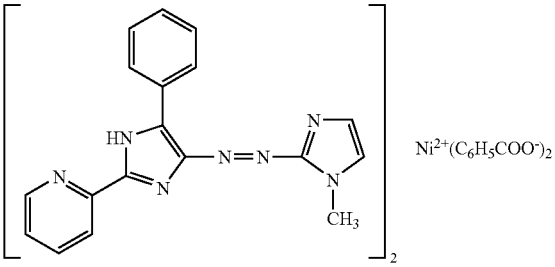
D-48
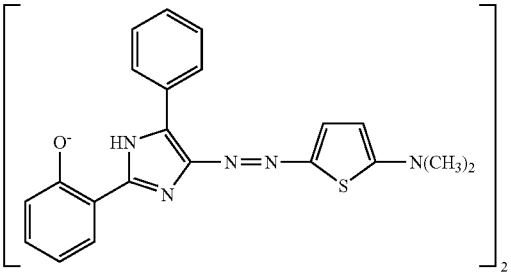
D-49
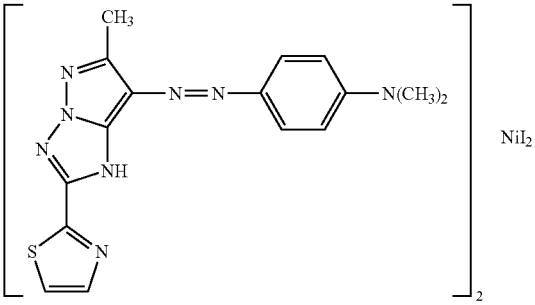
D-50
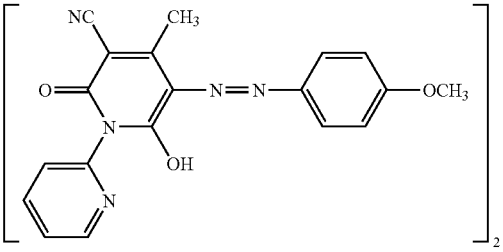
D-51
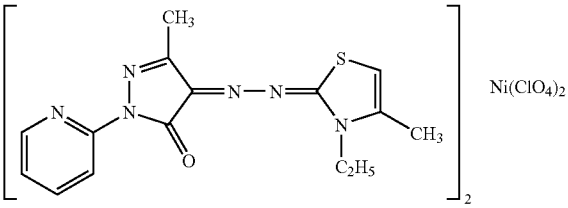
D-52
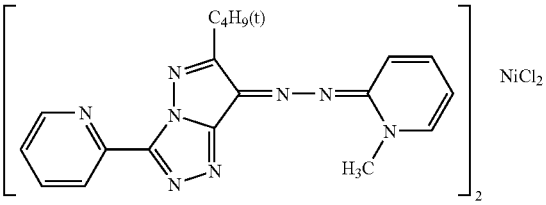

-continued
D-53
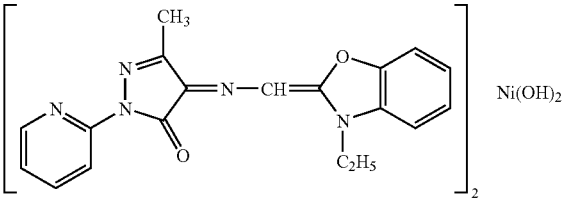
$Ni(OH)_2$
D-54
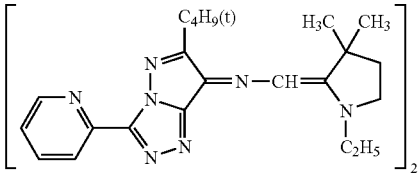
$Zn^{2+}(CH_3COO^-)_2$
D-55
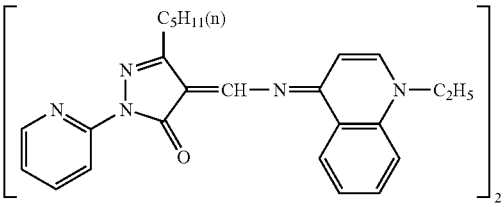
$NiCl_2$
D-56
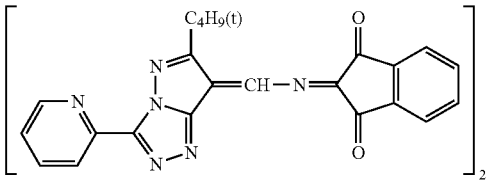
$Ni(OH)_2$
D-57
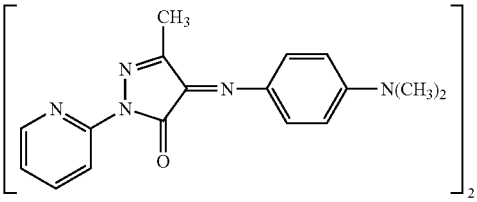
$Ni(ClO_4)_2$
D-58
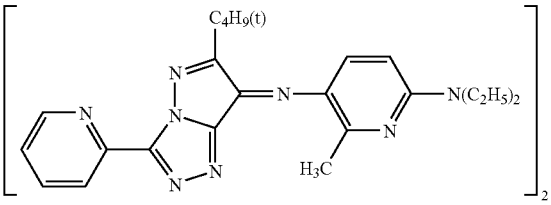
$Ni^{2+}$
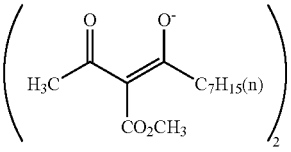
D-59
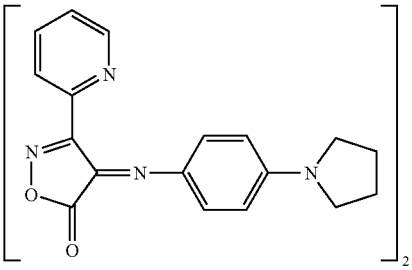
$Ni(BF_4)_2$
D-60
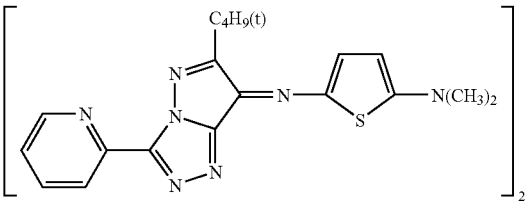
$Ni^{2+}(p\text{-}CH_3—C_6H_4SO_3^-)_2$
D-61
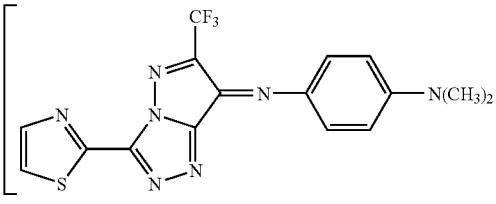
$Ni^{2+}$
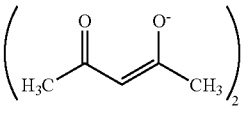

-continued
D-62
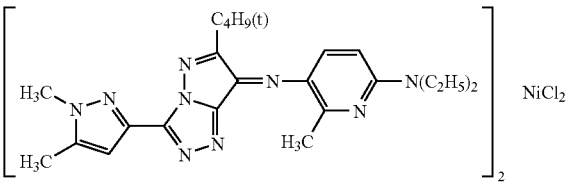
D-63
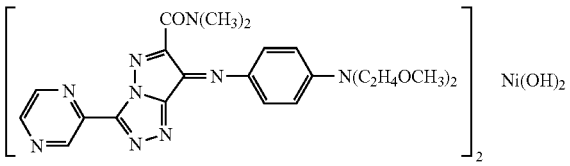
D-64
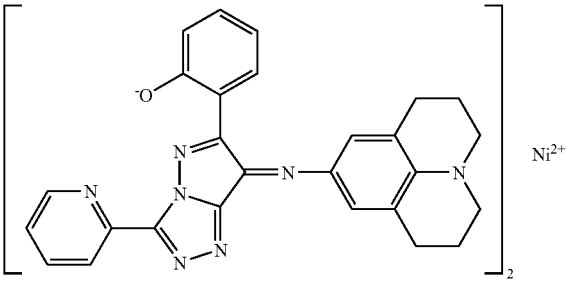
D-65
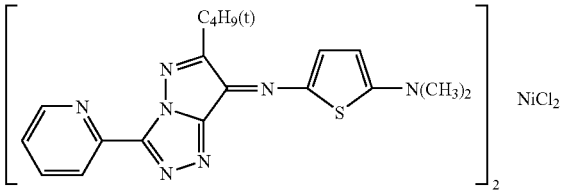
D-66
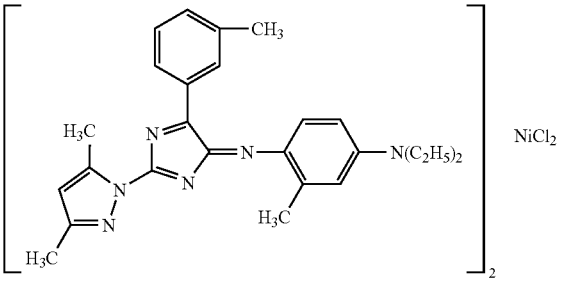
D-67
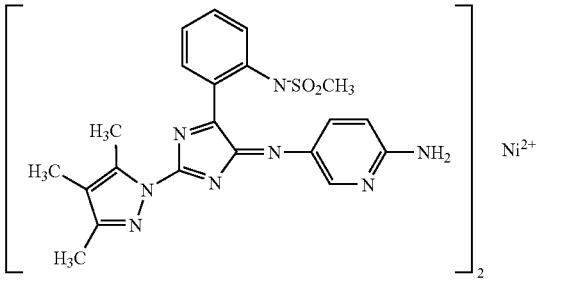
D-68
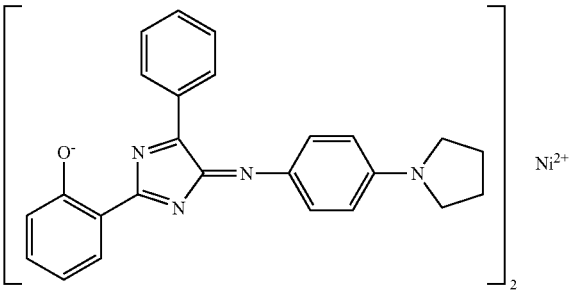
D-69
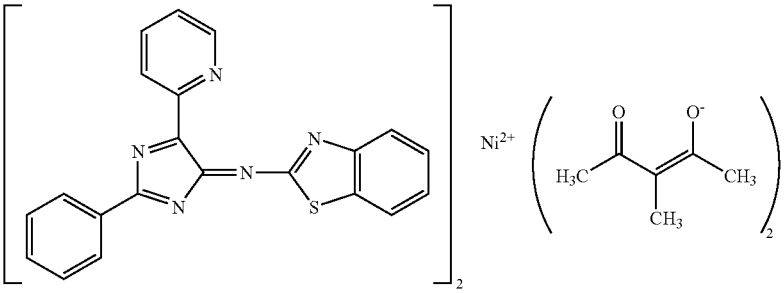

-continued

D-70

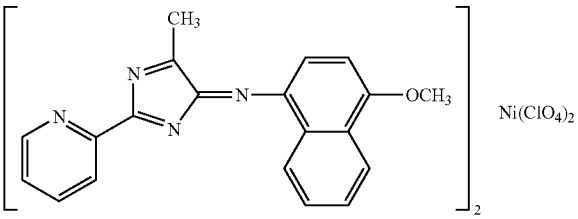

Colored microparticles usable in the invention exhibit a volume median diameter of from 10 to 300 nm, and preferably from 20 to 100 nm. A volume median diameter falling with the foregoing range results in enhanced enclosure of a colorant in the resin forming colored microparticles, leading to enhanced stability of the colored microparticles and superior storage stability. Sedimentation of colored microparticles during preparation thereof is inhibited, leading to improved solution stability. Further, transparency as a toner is also superior. The volume median diameter of the colored microparticles can be determined using electrophoretic light-scattering photometer ELS-800 (produced by Otsuka Denshi Co.).

The colorant content of colored microparticles, which is represented by a weight ratio of colorant to resin (%), is preferably from 10% to 70% by weight, based on cross-linked polyester resin or nitrogen-containing polycondensate resin, and more preferably 15% to 55%. A content falling within the foregoing range results in toner images at a relatively high density.

The method of preparing a toner of the invention comprises the step of subjecting polyester resin particles and colored microparticles composed of a colorant and a crosslinked polyester resin or nitrogen-containing polycondensate resin to coagulation and fusion in an aqueous medium to obtain toner particles. The polyester resin particles can be obtained by the polymerization process comprising (i) dispersing a polymerization composition containing at least one carboxylic acid having a valence of two or more (hereinafter, also denoted as polyvalent carboxylic acid or polycarboxylic acid) and at least one alcohol having a valence of two or more (hereinafter, also denoted as polyvalent alcohol or polyhydric alcohol) in an aqueous medium containing a surfactant of a compound having a long chain hydrocarbon group and an acidic group (hereinafter, also denoted as acidic group-containing surfactant) in the form of oil-droplets dispersed in the aqueous medium, and (ii) subjecting the polyvalent carboxylic acid and the polyvalent alcohol to polycondensation to form the polyester resin particles.

In one embodiment of the invention, the method of preparing a toner of the invention comprises:

(1) an oil-droplet formation step in which a polyvalent carboxylic acid and a polyvalent alcohol are mixed to prepare a polymerization composition and this composition is dispersed in an aqueous medium containing an acidic group-containing surfactant to obtain an aqueous dispersion of polymerization composition in the form of oil-droplets dispersed in the aqueous medium, (2) a polymerization step in which the obtained aqueous dispersion of polymerization composition is subjected to polymerization (polycondensation) to obtain a dispersion of polyester resin particles, (3) a coagulation and fusion step in which the polyester resin particles, colored microparticles and optionally a toner constituent such as a particulate wax or particulate charge-controlling agent are coagulated and thermally fused in an aqueous medium to obtain toner particles, (4) a solid/liquid separation and washing step in which the obtained toner particles are separated from the aqueous medium and washed to remove surfactants and the like from the toner particles, (5) a drying step in which the washed toner particles are dried, and the method further includes (6) an external additive-incorporating step in which an external additive is incorporated to the dried toner particles.

The respective steps described above are further detailed.

(1) Oil-Droplet Formation Step:

A polymerization composition composed of a polyvalent carboxylic acid and a polyvalent alcohol is added to an aqueous medium containing an acidic group-containing surfactant at a concentration less than the critical micelle concentration and dispersed employing mechanical energy to form oil-droplets.

Dispersing machines to perform oil-droplet dispersion employing mechanical energy are not specifically limited and examples thereof include a stirring device provided with a high-speed rotor, CLEARMIX (produced by M-Technique Co.), an ultrasonic homogenizer, a mechanical homogenizer, a Manton-Gaulin homogenizer and a pressure homogenizer.

Dispersed oil-droplets exhibit a volume median diameter ($D_{50}$) of 50 to 500 nm, and more preferably 70 to 300 nm.

The above-mentioned aqueous medium refers to a medium containing water in an amount of at least 50% by weight. Constituents except for water include water-soluble organic solvents, for example, methanol, ethanol, isopropanol, butanol, acetone, methyl ethyl ketone, or tetrahydrofuran. Of these, it is preferred to use alcoholic solvents such as methanol, ethanol, isopropanol and butanol, any of which does not dissolve resin.

(2) Polymerization Step:

In the polymerization step, a polyvalent carboxylic acid and a polyvalent alcohol are polymerized within oil-droplets dispersed in the aqueous medium, formed in the foregoing oil-droplet formation step to form polyester resin particles.

Acidic group-containing surfactant molecules are arranged on the surface of the formed oil-droplet, while allowing a hydrophilic group of an acidic group to be orientated toward the water phase and a hydrophobic group of a long chain hydrocarbon group to orientate toward the oil phase. The acidic group existing in the interface between an oil-droplet and the water phase displays a catalytic effect on dehydration to remove water formed in polycondensation from the oil-droplet. As a result, it is assumed that polycondensation accompanying dehydration proceeds in the oil-droplet existing in the aqueous medium.

The polymerization temperature to perform polycondensation, depending on the kinds of a polyvalent carboxylic acid and a polyvalent alcohol contained in the polymerization composition, is usually 40° C. or more, preferably from 50 to 150° C., and more preferably from 50 to 100° C. for the purpose of being lower than the boiling point of water in the aqueous medium. The polymerization time, depending on the reaction rate of polycondensation to form polyester resin particles, is usually from 4 to 10 hr.

Polyester resin particles exhibit a weight-average molecular weight (Mw) of 10,000 or more, preferably from 20,000 to 10,000,000, and more preferably from 30,000 to 1,000,000. The molecular weight (Mw) can be determined in gel permeation chromatography (GPC). A weight-average molecular weight falling within the foregoing range can inhibit the offset phenomenon occurred in the fixing stage at a relative high temperature in the toner image forming process.

Polyester resin particles exhibit a number-average molecular weight (Mn) of 20,000 or more, preferably from 1,000 to 10,000, and more preferably from 2,000 to 8,000. The molecular weight (Mn) can be determined in gel permeation chromatography (GPC). A weight-average molecular weight falling within the foregoing range can achieve low-temperature fixability in the fixing stage of image formation using the toner and also achieves desired glossiness of images obtained in the image formation using a color toner.

(3) Coagulation and Fusion Step:

In the coagulation step, a dispersion of polyester resin particles obtained in the foregoing step (2) of polymerization and a dispersion of colored microparticles and optionally, particles of toner constituents such as wax, a charge controlling agent or the like, are mixed to prepare a dispersion used for coagulation. Subsequently, the polyester resin particles and the colored microparticles are coagulated and thermally fused in an aqueous medium to form a dispersion of toner particles.

More specifically, to the coagulation on dispersion is added a coagulant at a concentration more than the critical coagulation concentration to cause salting out. Concurrently, while stirring in a reactor provided with a stirring mechanism having a stirring blade (as shown, for example, in FIG. 1), the coagulated particles are thermally fused to form coalesced particles and grow the particles. When reaching the intended particle size, a large amount of water is added thereto to terminate the particle growth. Further heating and stirring smoothen the particle surface to control the particle shape to form targeted toner particles.

Concurrently with a coagulant, an organic solvent infinitely soluble in water may be added to the dispersion for coagulation. Further, coagulating aids such as hydrated lime, bentonite, fly ash or kaolin may be used.

The critical coagulation concentration which is a measure with respect to stability of an aqueous dispersion, is the concentration at which coagulation is caused. The critical coagulation concentration varies greatly with the component of dispersed particles. The critical coagulation concentration can be precisely determined according to techniques described in, for example, S. Okamura et al., Kobunshi Kagaku (Polymer Chemistry) 17, 601 (1960), edited by Kobunshi-gakkai. Alternatively, while adding an intended salt to an objective dispersion for coagulation with varying the concentration thereof, the ζ-potential of the dispersion is measured and the salt concentration at which the potential changes is determined as the critical coagulation potential.

In the process of coagulation, the standing time after adding a coagulant (until staring heating) is preferably as short as possible. More specifically, after adding a coagulant, heating the dispersion is started as soon as possible to reach a temperature higher than the glass transition temperature of polyester resin particles. The reason therefor is not clear, but producing problems such that the coagulation state of particles varies with elapse of standing time and the particle size distribution of toner particles becomes unstable or the surface property varies. The standing time is usually 30 min. or less, and preferably 10 min. or less. The temperature for adding a coagulant is not specifically limited but is preferably lower than the glass transition temperature of the used polyester resin particles.

In the process of coagulation, the temperature is preferably raised promptly by heating and the temperature-raising rate is preferably 1° C./min or more. The upper limit of the temperature-raising rate is not limited but is preferably 15° C./min or less in terms of inhibiting production of coarse particles due to propagation of rapid fusion. Furthermore, after reaching a temperature higher than the glass transition temperature, it is preferable to maintain the dispersion at that temperature to continue fusion. Thereby, growth of toner particles (coagulation of polyester resin particles and colored microparticles) and fusion (disappearance of the interface between particles) effectively proceed, leading to enhanced durability of finally obtained toner particles.

In the present invention, the coagulation and fusion can be taken place separately or simultaneously.

(4) Solid/Liquid Separation and Washing Step:

In the solid/liquid separation and washing step, toner particles are separated through solid/liquid separation from the toner particle dispersion obtained in the foregoing coagulation step and the separated toner cake (an aggregate of wetted toner particles being aggregated in a cake form) is subjected to a washing treatment to remove attachments such as surfactants or coagulants from the toner particles. The foregoing solid/liquid separation and washing is conducted by centrifugal separation, reduced pressure solid/liquid separation using a Nutsche funnel, or solid/liquid separation and washing by using a filter press, but is not specifically limited.

(5) Drying Step:

In the drying step, the thus washed toner particles are subjected to a drying treatment. Drying machines such as a spray dryer, vacuum free-dryer or a reduced pressure drying machine can be employed. The moisture content of dried toner particles is preferably not more than 1.0% by weight, and more preferably not more than 0.5% by weight.

The moisture content can be determined by the Karl Fischer method. When dried toner particles aggregated through a weak attractive force between particles to form a aggregate, the aggregate may be subjected to a disintegration treatment. There are usable mechanical disintegrating apparatuses such as a jet mill, a Henschel mixer, a coffee mill or a food processor.

(6) External Additive-Incorporating Step:

In the step of adding external additives, external additives are incorporated to the dried toner particles to improve fluidity or an electrostatic property and to enhance cleaning capability. Examples of a device used for adding external additives include a turbulent mixer, Henschel mixer, a Nauta mixer or a V-type mixer.

There will be described materials used for preparation of toners.

A polyvalent carboxylic acid contained in the polymerization composition used in the invention is a carboxylic acid having a valence of two or more, i.e., an acid having two or more carboxyl groups. Examples thereof include dicarboxylic acids such as oxalic acid, malonic acid, succinic acid, glutaric acid, adipic acid, pimelic acid, suberic acid, azelaic acid, sebacic acid, maleic acid, fumaric acid, citraconic acid, itaconic acid, glutaconic acid, n-dodecylsuccinic acid, n-dodecenylsuccinic acid, isododecylsuccenic acid, isododecenylsuccinic acid, n-octylsuccinic acid and n-octenylsuccinic acid; aromatic dicarboxylic acids such as phthalic acid, isophthalic acid, terephthalic acid, and naphthalenedicarboxylic acid; and carboxylic acid having a valence of 3 or more, such as trimellitic acid and pyromellitic acid.

Polyvalent carboxylic acids are usable alone or in combination thereof. The use of a polycarboxylic acid having a valence of 3 or more can obtain a polyester resin having a crosslinked structure. The proportion of polycarboxylic acids having a valence of 3 or more is preferably from 0.1% to 30% by weight, based on the total polyvalent carboxylic acids.

A polyvalent alcohol contained in the polymerization composition used in the invention is an alcohol having a valence of two or more, i.e., an alcohol having two or more hydroxyl groups, which is also denoted as a polyhydric alcohol. Examples thereof include dioles such as ethylene glycol, diethylene glycol, triethylene glycol, 1,2-propylene glycol, 1,3-propylene glycol, 1,4-butane diol, 1,4-bytylene diol, neopentylene glycol, 1,5-pentanediol, 1,6-hexanediol, 1,7-heptanediol, 1,8-octanediol, 1,9-nonanediol, 1,10-decanediol, pinacol, cyclopentane-1,2-diol, cyclohexane-1,4-diol, cyclohexane-1,2-diol, cyclohexane-1,4-dimethanol, dipropylene glycol, dipropylene glycol, polyethylene glycol, polypropylene glycol, polytetramethylene glycol, bisphenol A, bisphenol Z and hydrogenated bisphenol A; polyvalent aliphatic alcohols having a valence of 3 or more, such as glycerin, trimethylolpropane, pentaerythritol, sorbitol, trisphenol PA, phenol novolac and cresol novolac; and an alkylene oxide adduct of a polyvalent alcohol having a valence of 3 or more, as described above.

Polyvalent alcohols are usable alone or in combinations thereof. The use of a polyvalent alcohol having a valence of 3 or more can obtain a polyester resin having a crosslinking structure. The proportion of polyvalent alcohols having a valence of 3 or more is preferably from 0.1% to 30% by weight, based on the total polyvalent alcohols.

The ratio of polyvalent alcohol to polyvalent carboxylic acid, which is represented by an equivalent ratio of a hydroxyl group [OH] of the polyvalent alcohol to a carboxyl group [COOH] of the polycarboxylic acid, i.e., expressed in [OH]/[COOH], is preferably from 1.5/1 to 1/1.5, and more preferably from 1.2/1 to 1/1.2. Herein, the equivalence ratio, [OH]/[COOH] is defined as follows. The equivalent ratio of hydroxyl group [OH] of N moles of a polyvalent alcohol having a valence of n to carboxyl group [COOH] of M moles of a polyvalent carboxylic acid having a valence of m is represented as below:

$$[OH]/[COOH]=(n\times N)/(m\times M).$$

A ratio of polyvalent alcohol to polyvalent carboxylic acid falling within the foregoing range can obtain a polyester resin having the targeted molecular weight.

The polyvalent carboxylic acid and the polyvalent alcohol are chosen so that a polyester resin obtained by polycondensation preferably exhibits a glass transition temperature (or point) of 20-90° C. and more preferably 35-65° C., and a softening temperature (or point) of 80-220° C. and more preferably 80-150° C.

The polymerization composition may contain an extremely small amount of a monovalent carboxylic acid and/or monovalent alcohol, together with polyvalent carboxylic acids and polyvalent alcohols. Such a monovalent carboxylic acid and/or monovalent alcohol functions as a polymerization terminator in polycondensation of the oil-droplet, so that an addition amount thereof can control the molecular weight of the targeted polyester resin.

The polymerization composition used in the preparation of toners of the invention may contain oil-soluble constituents such as an organic solvent. Examples of such an organic solvent include one which exhibits a relatively low boiling point and low solubility in water, such as toluene or ethyl acetate. The polymerization composition may also include a colorant or wax. Polymerization of such a composition, including a colorant or wax, can obtain a colored or wax-containing polyester resin. The wax content is preferably 2% to 20% by weight, based on the total polymerization composition, more preferably 39% to 18% by weight, and still more preferably 2% to 15% by weight.

An acidic group-containing surfactant usable in the invention is a compound having a hydrophobic group composed of a long chain hydrocarbon group and a hydrophilic group of an acidic group. The long chain hydrocarbon group is a hydrocarbon group having a main chain of 8 or more carbon atoms. Examples of a long chain hydrocarbon group include an alkyl group having 8 to 40 carbon atoms and an aromatic hydrocarbon group which may be substituted by an alkyl group. Specifically, a phenyl group containing an alkyl group of 8 to 30 carbon atoms is preferred.

An acidic group constituting the acidic group-containing surfactant is preferably one exhibiting a relatively high acidity. Examples of such an acidic group include a sulfonic acid group, a carboxylic acid group, and a phosphoric acid group. Of these, the sulfonic acid group is preferred.

Preferred examples of an acidic group-containing surfactant include a sulfonic acid, a carboxylic acid and a phosphoric acid, each containing a long chain hydrocarbon group. Specific examples thereof include a sulfonic acid such as dodecylsulfonic acid, eicosylsulfonic acid, decylbenzenesulfonic acid, dodecylbenzenesulfonic acid and eicosylbenzenesulfonic acid; a carboxylic acid such as dodecylcarboxylic acid; and a phosphoric acid such as dodecylphosphoric acid and eicosylphosphoric acid.

The acidic group-containing surfactant is one in which an acidic group is bound to a long chain hydrocarbon group via an inorganic group or an organic group and preferably is one in which an acidic group is directly bond to a long chain hydrocarbon group. The reason therefor is not definite but it is assumed that the structure of a long chain hydrocarbon group as a hydrophobic group, directly bound to an acidic group as a hydrophilic group results in a state in which the acidic group is oriented toward the aqueous medium (water phase) and the hydrophobic group is oriented toward an oil-droplet (oil phase) composed of a polymerization composition, leading to stabilization of the oil-droplet. Concurrently, water produced in polycondensation is effectively discharged to the water phase.

The acidic group-containing surfactant is contained in the aqueous medium, preferably at a concentration less than the critical micelle concentration of the surfactant. Thus, containing an acidic group-containing surfactant at a concentration less than the critical micelle concentration results in stable formation of oil-droplets in the aqueous medium without formation of a micelle. It is also assumed that since the surfactant is not excessive, all surfactant molecules are appropriately oriented around the oil-droplets, leading to stable formation of oil-droplets. It is further assumed that a function of an acidic group as a catalyst relating to dehydration in polycondensation of the above-mentioned polymerization step (2) is definitely displayed to enhance the reaction rate of polycondensation.

More specifically, the acidic group-containing surfactant is contained, in the aqueous medium, at any concentration less than the critical micelle concentration of the surfactant, preferably at a concentration of not more than 80% of the critical micelle concentration, and more preferably not more than 70%. With respect to the lower limit of the amount of an acidic group-containing surfactant to be added, it may be an amount capable of displaying a catalytic effect on polyesterification reaction. Specifically, the concentration in the aqueous medium is preferably from 0.01% to 2% by weight, and more preferably from 0.1% to 1.5% by weight.

To enhance stability of oil-droplets, appropriate anionic surfactants or nonionic surfactants may be contained in the aqueous medium.

Examples of a wax forming wax particles include hydrocarbon waxes such as a low molecular weight polyethylene wax, a low molecular weight polypropylene wax, Fischer-Tropsch wax, microcrystalline wax and paraffin wax; and ester waxes such as carnauba wax, pentaerythritol behenic acid ester and citric acid behenyl. These may be used alone or in combination. The wax content is preferably from 25 to 20% by weight, based on all of the toner, more preferably 3% to 18% by weight, and still more preferably from 4% to 15% by weight.

Coagulants usable in the invention are not specifically limited but those chosen from metal salts are suitably usable. Such metal salts are salts of monovalent metals such as an alkali metal, e.g., sodium, potassium and lithium, salts of divalent metals, e.g., calcium, magnesium, manganese and copper; and salts of trivalent metals, e.g., iron and aluminum. Specific examples thereof include sodium chloride, potassium chloride, lithium chloride, calcium chloride, magnesium chloride, zinc chloride, copper sulfate, magnesium sulfate and manganese sulfate. Of these, salts of divalent metals are preferred. Coagulation can be achieved using a divalent metal salt at a relatively small amount. The above described metal salts may be used alone or in combination. A coagulant is added to a dispersion for coagulation in an amount of more than the critical coagulation concentration, preferably at least 1.2 times critical coagulation concentration and more preferably at least 1.5 time critical coagulation concentration.

Organic solvents infinitely soluble in water, usable in the invention are chosen from ones which do not dissolve ester resin. Specific examples thereof include methanol, ethanol, 1-propanol, 2-propanol, ethylene glycol, glycerin and acetone, and alcohols having not more than three carbon atoms is preferred, for example, methanol, ethanol, 1-propanol, and 2-propanol, and 2-propanol is specifically preferred. These solvents are added preferably in an amount of 1% to 100% by volume, based on a dispersion before adding a coagulant.

Charge controlling agents to constitute charge controlling agent particles which are commonly known in the art and are dispersible in an aqueous medium, are usable in the invention. Specific examples thereof include Nigrosine dyes, metal salts of naphthenic acid or higher fatty acids, alkoxylated amines, quaternary ammonium compounds, azo metal complexes, and a salicylic acid metal salt and its metal complex. Dispersed charge controlling agent particles have a volume median diameter of 10 to 500 nm.

External additives usable in the invention are not specifically limited and various kinds of inorganic particles, organic particle and lubricants are usable. For instance, inorganic particles of silica, titania or alumina are preferably used and these inorganic particles are preferably subjected to a treatment for hydrophobicity, using a silane coupling agent or a titanium coupling agent.

An extent of the treatment for hydrophobicity is not specifically limited but the treatment is applied preferably to a level of methanol-wettability of 40 to 95. The methanol-wettability is a measure of wettability with methanol and measured as follows. 0.2 g of inorganic particles to be measured is weighed out and added into 50 ml of distilled water in a 200 ml beaker. Methanol is gradually added with slowly stirring from a burette whose top is dipped in liquid until the entire inorganic particles are wetted. The degree of hydrophobicity is determined by the following equation:

$$\text{Degree of hydrophobicity}=\{a/(a+50)\}\times 100$$

wherein "a" is the amount (ml) of methanol necessary to completely wet inorganic particles.

External additive are incorporated preferably at 0.1-5.0% by weight, and more preferably 0.5-4.0% by weight. Various combinations of external additives are feasible.

In the following, a reaction apparatus used for toner preparation will be described.

In preparation of toner particles, by allowing polyester resin particles and colored microparticles to be coagulated and fused in an aqueous medium, a laminar flow is formed within the reactor and the temperature, rotation number and time in the coagulation stage are controlled using a stirring blade and a stirring vessel which are capable of rendering a uniform internal temperature distribution, whereby a prescribed shape factor and high uniformity in shape distribution can be attained. The reason of obtaining high uniformity in shape distribution is presumed to be that when the coagulation step is performed in the field of forming a laminar flow, strong stress is not applied to coagulated particles in the process of coagulating and fusing and the temperature distribution within the stirring vessel becomes uniform under an accelerated laminar flow, resulting in coagulated particles of uniform shape distribution. Further, coagulated particles are gradually rounded by heating and stirring in the shape control stage, whereby the shape of the obtained toner particles can be optimally controlled.

FIG. 1 is a perspective view showing an example of a reactor used for preparation of the toner of the invention.

In FIG. 1, the numeral 1 designates a jacket for heat exchange, the numerals 2 and 3 designate a stirring vessel and a rotating shaft, respectively, and 4*a* and 4*b* are each a stirring blade. The numeral 7 is an upper charging inlet, the numeral 8 is a lower charging inlet and "α" designates a crossing angle of the stirring blades.

The reactor shown in FIG. 1 has a feature that stirring blades of multistage constitution are installed, in which the upper stirring blade is provided in advance at a crossing angle of α in the rotational direction to the lower stirring blade and no block such as a baffle, causing a turbulent flow is provided within the stirring vessel.

In the reactor shown in FIG. 1, the rotation shaft (3) is vertically provided at the central portion of vertically cylindrical stirring vessel provided with a jacket for heat exchange (1) on the periphery. The lower stirring blade (4*b*) is positioned close to the bottom of the vessel (2) and attached to the shaft (3) and further on the upper side, the upper stirring blade (4*a*) is provided. The upper stirring blade (4*a*) is in advance to the lower stirring blade (4*b*) at a crossing angle of α in the rotational direction.

In the preparation method of toners of the invention, the crossing angle between stirring blades 4*a* and 4*b* is preferably less than 90°. The lower limit of the crossing angle is not specifically limited. A crossing angle of not less than 5° and less than 90° is preferred and a crossing angle of not less than 10° and less than 90° is more preferred.

In such a constitution, a dispersion to be coagulated is first stirred by the stirring blade (4*a*) provided on the upper side to form a flow toward the lower side. Subsequently, the flow formed by the stirring blade (4*a*) of the upper side is accelerated toward the lower direction by the stirring blade (4*b*) provided on the lower side. Simultaneously, a downward flow is separately formed by the upper stirring blade (4*a*) and it is assumed that the overall flow acceleratingly proceeds.

The form of the stirring blade is not specifically limited, unless a turbulent flow is to be formed therein. A stirring blade formed of the continuous surface having no throughhole, for example, in the form of a rectangular plate shown in FIG. 1, is preferred. The stirring blade may also be formed of a curved surface.

The stirring blade forms no turbulent flow, whereby coalescence of polyester resin particles is caused in the polymerization step and no re-dispersion due to destruction of particles occurs. Excessive collision of particles is inhibited in the coagulation step, resulting in enhanced uniformity in particle size distribution and leading to toner particles of uniform particle size distribution. Further, excessive coalescence of particles is inhibited, whereby toner particles of a uniform shape can be obtained.

EXAMPLES

The present invention will be further described with reference to examples but the embodiments of the invention are by no means limited to these.

Example 1

Preparation of Polyester Resin Particles

Polyester Resin Particle 1:

A solution of 32 g of azelaic acid and 28 g of 1,10-deconadiol, heated at 95° C. was added to an aqueous solution of 2 g of dodecylbenzenesulfonic acid dissolved in 240 g of water and dispersed using an ultrasonic homogenizer to form oil-droplets. Subsequently, the reaction solution was heated to 95° C. and reacted over a period of 24 hr. to prepare a dispersion of polyester resin particle 1. The thus prepared polyester resin particle 1 exhibited a weight-average molecular weight (Mw) of 20,000, a number-average molecular weight (Mn) of 10,000, a glass transition temperature (Tg) of 60° C. and a softening point of 125° C., and was comprised of particles exhibiting a volume median diameter of 220 nm. The weight-average molecular weight and the number-average molecular weight were each determined by gel permeation chromatography) GPC) and the volume median diameter was determined using electrophoresis light-scattering photometer ELS-800 (produced by Otsuka Denshi Co.).

Polyester Resin Particle 2:

A solution of 22 g of polyoxyethylene (2,2)-2,2-bis(4-hydroxyphenyl)propane, 1.2 g of neopentylene glycol, 10 g of terephthalic acid and 0.6 g of isophthalic acid, heated at 95° C. was added to an aqueous solution of 3 g of dodecylbenzenesulfonic acid dissolved in 240 g of water and dispersed using an ultrasonic homogenizer to form oil-droplets. Subsequently, the reaction solution was heated to 98° C. and reacted over a period of 36 hr. to prepare a dispersion of polyester resin particle 2. The thus prepare polyester resin particle 2 exhibited a weight-average molecular weight (Mw) of 30,000, a number-average molecular weight (Mn) of 9,000, a glass transition temperature (Tg) of 52° C. and a softening point of 117° C., and was comprised of particles exhibiting a volume median diameter of 230 nm.

Polyester Resin Particle 3:

A solution of 22 g of polyoxyethylene (2,2)-2,2-bis(4-hydroxyphenyl)propane, 1.2 g of neopentylene glycol, 9.5 g of terephthalic acid, 0.5 g of isophthalic acid and 0.5 g of trimellitic acid, heated at 95° C. was added to an aqueous solution of 3 g of dodecylbenzenesulfonic acid dissolved in 240 g of water and dispersed using an ultrasonic homogenizer to form oil-droplets. Subsequently, the reaction solution was heated to 95° C. and reacted over a period of 24 hr. to prepare a dispersion of polyester resin particle 2. The thus prepare polyester resin particle 3 exhibited a weight-average molecular weight (Mw) of 50,000, a number-average molecular weight (Mn) of 5,000, a glass transition temperature (Tg) of 56° C. and a softening point of 120° C., and was comprised of particles exhibiting a volume median diameter of 210 nm.

Preparation of Crosslinked Polyester Resin Solution

Crosslinked Polyester Resin Solution 1:

52 parts of anhydrous trimellitic acid as a polycarboxylic acid, 156 parts of terephthalic acid, 58 parts of isophthalic acid as a dicarboxylic acid, 120 parts of polyoxyethylene (2,4)-2,2-bis(4-hydroxyphenyl)propane as an aromatic diol, 140 parts of ethylene glycol as an aliphatic diol and tetrabutyltitanate as a polymerization catalyst of 0.3% by weight, based on the total amount of monomers were placed into a separable flask in the upper side of which a thermometer, a stirring bar, a condenser and a nitrogen gas-introducing tube were provided. The thus prepared mixture was reacted in an electrothermic mantle heater under nitrogen gas stream of normal pressure at 220° C. for 7 hr. Thereafter, the pressure was successively reduced and the reaction continued at a pressure of $1.33\times10^3$ Pa for 2 hr. to obtain polycondensate resin 1 exhibiting an acid value of 8.9, a hydroxyl value of 29, a peak top molecular weight of 8,700, Mw/Mn of 4.0 and a Tg of 65° C. 200 parts of the polycondensate resin 1 was dissolved in 200 parts of ethyl acetate to obtain crosslinked polyester resin solution 1.

Crosslinked Polyester Resin Solution 2:

59 parts of anhydrous pyromellitic acid as a polycarboxylic acid, 156 parts of terephthalic acid, 58 parts of isophthalic acid as a dicarboxylic acid, 120 parts of polyoxyethylene (2,4)-2,2-bis(4-hydroxyphenyl)propane as an aromatic diol, 140 parts of ethylene glycol as an aliphatic diol and tetrabutyltitanate as a polymerization catalyst of 0.3% by weight, based on the total amount of monomers were placed into a separable flask in the upper side of which a thermometer, a stirring bar, a condenser and a nitrogen gas-introducing tube were provided. The thus prepared mixture was reacted in an electrothermic mantle heater under nitrogen gas stream of normal pressure at 220° C. for 7 hr. Thereafter, the pressure was successively reduced and the reaction continued at a pressure of $1.33\times10^3$ Pa for 2 hr. to obtain polycondensate resin 2 exhibiting an acid value of 8.9, a hydroxyl value of 29, a peak top molecular weight of 8,700, Mw/Mn of 4.0 and Tg of 65° C. 200 parts of the polycondensate resin 1 was dissolved in 200 parts of ethyl acetate to obtain crosslinked polyester resin solution 1.

Non-Crosslinked Polyester Resin Solution 3:

Into a reaction vessel provided with a condenser, a stirrer and a nitrogen gas introducing tube were placed 450 parts of an adduct of bisphenol A and 2 mol of ethylene oxide, 107 parts of isophthalic acid and 108 parts of terephthalic acid, and polycondensation was performed under atmospheric pressure at 200° C. for 3 hr. to obtain polycondensate resin 3 exhibiting an acid value of 3, a hydroxyl value of 25, a peak top molecular weight of 46,000, a value of Mw/Mn of 4.0 and a Tg of 60° C. 200 parts of the polycondensate resin 3 was dissolved in 200 parts of ethyl acetate and mixed to obtain non-crosslinked polyester resin solution 3.

Preparation of Colored Microparticle Dispersion

Colored Microparticle Dispersion D-1-1:

Into a separable flask, 90 g of the crosslinked polyester resin solution 1, 54 g of C.I. Solvent Blue 94 and 360 g of ethyl acetate were added and completely dissolved with stirring to obtain a solution. The thus obtained solution was added to an aqueous surfactant solution of 27 g of sodium dodecylsulfate dissolved in 780 g of water and dispersed using an ultrasonic dispersing machine. Thereafter, ethyl acetate was removed under reduced pressure at 40° C. To this dispersion, 18 g of ethylene glycol was added and heated to 60° C. with stirring to perform a reaction to prepare a dispersion of colored microparticles. The thus prepared dispersion of colored microparticles was designated as colored microparticle dispersion D-1-1. The colored microparticles exhibited a volume median diameter of 44 nm.

Colored Microparticle Dispersion D-1-2:

A dispersion of colored microparticles was prepared similarly to the foregoing colored microparticle dispersion D-1-1, except that the crosslinked polyester resin solution 1 was replaced by the crosslinked polyester resin solution 2. The thus prepared dispersion of colored microparticles was designated as colored microparticle dispersion D-1-2. The colored microparticles exhibited a volume median diameter of 53 nm.

Colored Microparticle Dispersion D-1-3:

A dispersion of colored microparticles was prepared similarly to the foregoing colored microparticle dispersion D-1-1, except that C.I. Solvent Blue 94 was replaced by metal chelate dye (A-1). The thus prepared dispersion of colored microparticles was designated as colored microparticle dispersion D-1-3. The colored microparticles exhibited a volume median diameter of 55 nm.

Metal chelate dye A-1

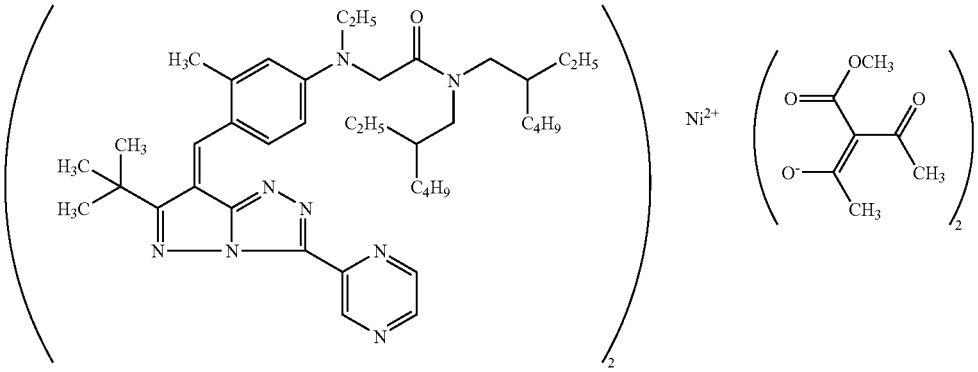

Colored Microparticle Dispersion D-1-4:

A dispersion of colored microparticles was prepared similarly to the foregoing colored microparticle dispersion D-1-1, except that C.I. Solvent Blue 94 was replaced by C.I. Solvent Yellow 16. The thus prepared dispersion of colored microparticles was designated as colored microparticle dispersion D-1-4. The colored microparticles exhibited a volume median diameter of 60 nm.

Colored Microparticle Dispersion D-1-5:

A dispersion of colored microparticles was prepared similarly to the foregoing colored microparticle dispersion D-1-1, except that 90 g of the crosslinked polyester resin solution 1 was changed to 168 g of that and 54 g of C.I. Solvent Blue 94 was changed to 15 g of that. The thus prepared dispersion of colored microparticles was designated as colored microparticle dispersion D-1-5. The colored microparticles exhibited a volume median diameter of 85 nm.

Colored Microparticle Dispersion D-1-6:

A dispersion of colored microparticles was prepared similarly to the foregoing colored microparticle dispersion D-1-1, except that 90 g of the crosslinked polyester resin solution 1 was changed to 168 g of that and 54 g of C.I. Solvent Blue 94 was changed to 5 g of that. The thus prepared dispersion of colored microparticles was designated as colored microparticle dispersion D-1-6. The colored microparticles exhibited a volume median diameter of 83 nm.

Colored Microparticle Dispersion D-1-7:

A dispersion of colored microparticles was prepared similarly to the foregoing colored microparticle dispersion D-1-1, except that 90 g of the crosslinked polyester resin solution 1 was changed to 30 g of that and 54 g of C.I. Solvent Blue 94 was changed to 84 g of that. The thus prepared dispersion of colored microparticles was designated as colored microparticle dispersion D-1-7. The colored microparticles exhibited a volume median diameter of 52 nm.

Colored Microparticle Dispersion D-1-8:

A dispersion of colored microparticles was prepared similarly to the foregoing colored microparticle dispersion D-1-1, except that the crosslinked polyester resin solution 1 was changed to the non-crosslinked polyester resin solution 3. The thus prepared dispersion of colored microparticles was designated as colored microparticle dispersion D-1-8. The colored microparticles exhibited a volume median diameter of 42 nm.

Colored Microparticle Dispersion D-1-9:

A dispersion of colored microparticles was prepared similarly to the foregoing colored microparticle dispersion D-1-8/except that C.I. Solvent Blue 94 was changed to metal chelate dye (A-1). The thus prepared dispersion of colored microparticles was designated as colored microparticle dispersion D-1-9. The colored microparticles exhibited a volume median diameter of 53 nm.

Colored Microparticle Dispersion D-1-10:

A dispersion of colored microparticles was prepared similarly to the foregoing colored microparticle dispersion D-1-1, except that odium dodecylsulfate was changed from 27 g to 4 g. The thus prepared dispersion of colored microparticles was designated as colored microparticle dispersion D-1-10. The colored microparticles exhibited a volume median diameter of 420 nm.

Colored Microparticle Dispersion D-1-11:

90 g of sodium dodecylsulfate was added to 1 liter of pure water and dissolved with stirring. To the solution, 120 g of C.I. Pigment Blue 15-3 was gradually added, stirred for 1 hr. and continuously dispersed over a period of 20 hr. using a sand grinder (medium type dispersing machine) to prepare a dispersion of colored microparticles. The thus prepared dispersion of colored microparticles was designated as colored microparticle dispersion D-1-1. The colored microparticles exhibited a volume median diameter of 120 nm.

Colored Microparticle Dispersion D-1-12:

A dispersion of colored microparticles was prepared similarly to the foregoing colored microparticle dispersion D-1-1, except that the crosslinked polyester resin solution 1 was replaced by 45 g of styrene/acrylate (80/20 by wt %) resin (exhibiting a weight-average molecular weight of 20,000). The thus prepared dispersion of colored microparticles was designated as colored microparticle dispersion D-112. The colored microparticles exhibited a volume median diameter of 50 nm.

Preparation of Wax Dispersion

Wax Dispersion 1:

1.0 g of anionic surfactant, sodium dodecylbenzenesulfonate was dissolved in 30 ml of deionized water with stirring. The obtained solution was heated to 90° C. and 7 g of carnauba wax (purified Carnauba wax No. 1) melted by heating at 90° C., was gradually added thereto, dispersed at 90° C. over a period of 7 hr. using a mechanical dispersing machine CLEARMIX (produced by M-Technique Co) and cooled to 30° C. to prepare a wax dispersion. The thus prepared dispersion was designated as wax dispersion 1. The number-average particle size of wax particles in the wax dispersion was 95 nm. The number-average particle size was determined using electrophoresis light-scattering photometer ELS-800 (produced by Otsuka Denshi Co.).

Wax Dispersion 2:

1.0 g of anionic surfactant, sodium dodecylbenzenesulfonate was dissolved in 30 ml of deionized water with stirring. The obtained solution was heated to 90° C. and 7 g of pentaerythritol behenic acid ester melted by heating at 90° C., was gradually added thereto, dispersed at 90° C. over a period of 7 hr. using a mechanical dispersing machine CLEARMIX (produced by M-Technique Co) and then cooled to 30° C. to prepare a wax dispersion. The thus prepared dispersion was designated as wax dispersion 2. The number-average particle size of wax particles in the wax dispersion was 96 nm.

Wax Dispersion 3:

1.0 g of anionic surfactant, sodium dodecylbenzenesulfonate was dissolved in 30 ml of deionized water with stirring. The obtained solution was heated to 90° C. and 7 g of Fischer-Tropsch wax melted by heating at 90° C., was gradually added thereto, dispersed at 90° C. over a period of 7 hr. using a mechanical dispersing machine CLEARMIX (produced by M-Technique Co) and then cooled to 30° C. to prepare a wax dispersion. The thus prepared dispersion was designated as wax dispersion 3. The number-average particle size of wax particles in the wax dispersion was 91 nm.

Preparation of Toner

Toner Particle 1-1:

1400 g of the above-described dispersion of polyester resin particle 1, 2,000 g of deionized water, 165 g of the colored microparticle dispersion D-1-1 and 125 g of the wax dispersion 1 were introduced into a 5 liter four-necked flask provided with a temperature sensor, a condenser, a nitrogen gas-introducing device and stirrer and stirred to prepare a mixture. After adjusting to a temperature of 30° C., an aqueous 5 mol/l sodium hydroxide solution was added to the mixture to adjust the pH to 10.0. Subsequently, an aqueous solution of 52.6 g of magnesium chloride hexahydrate dissolved in 72 g of deionized water was added thereto over a period of 10 at 30° C. with stirring. Then, after being allowed to stand for 3 min., the temperature was raised to 90° C. in 6 min. (at a temperature-raising rate of 10° C./min). While measuring the particle size in COULTER COUNTER TA-III (produced by Beckman Coulter Co.) and when reached a volume median diameter ($D_{50}$) of 6.5 μm, an aqueous solution of 115 g of sodium chloride dissolved in 700 g of deionized water was added thereto to stop growth of particles. The solution temperature was further maintained at 90±2° C. and stirring continued for 6 hr. to allow particles to be fused. Then, the reaction mixture was cooled to 30° C. at a rate of 6° C./min and hydrochloric acid was added thereto to adjust the pH and stirring was stopped. The thus formed toner particles were separated through solid/liquid separation and washing with deionized water was repeated four times (in an amount of 15 liters of deionized water). Thereafter, drying was carried out by hot air at 40° C. to obtain toner particles. The thus obtained toner particles were designated as toner particle 1-1.

Toner Particles 1-2 to 1-4:

Toner particles 1-2 to 1-4 were each prepared similarly to the foregoing toner particle 1-1, except that the colored microparticle dispersion D-1-1 was replaced by each of the colored microparticle dispersions D-1-2 to D-1-4.

Toner Particle 1-5:

1100 g of the above-described dispersion of polyester resin particle 1, 2,000 g of deionized water, 595 g of the colored microparticle dispersion D-1-5 and 100 g of the wax dispersion 1 were introduced into a 5 liter four-necked flask provided with a temperature sensor, a condenser, a nitrogen gas introducing device and stirrer and stirred to prepare a mixture. After adjusting to a temperature of 30° C., an aqueous 5 mol/l sodium hydroxide solution was added to the mixture to adjust the pH to 10.0. Subsequently, an aqueous solution of 52.6 g of magnesium chloride hexahydrate dissolved in 72 g of deionized water was added thereto over a period of 10 at 30° C. with stirring. The, after allowed to stand for 3 min., the temperature was raised to 90° C. in 6 min. (at a temperature-raising rate of 10° C./min). While measuring the particle size in COULTER COUNTER TA-III (produced by Beckman Coulter Co.) and when reached a volume median diameter ($D_{50}$) of 6.5 μm, an aqueous solution of 115 g of sodium chloride dissolved in 700 g of deionized water was added thereto to stop growth of particles. The solution temperature was further maintained at 90±2° C. and stirring continued for 6 hr. to allow particles to be fused. Then, the reaction mixture was cooled to 30° C. at a rate of 6° C./min and hydrochloric acid was added thereto to adjust the pH and stirring was stopped. The thus formed toner particles were separated through solid/liquid separation and washing with deionized water was repeated four times (in an amount of 15 liters of deionized water). Thereafter, drying was carried out by hot air at 40° C. to obtain toner particles. The thus obtained toner particles were designated as toner particle 1-5.

Preparation of Toner Particle 1-6:

Toner particle 1-6 was prepared similarly to the foregoing toner particle 1-5, except that the colored microparticle dispersion D-1-5 was replaced by the colored microparticle dispersions D-1-6.

Preparation of Toner Particle 1-7:

185 g of the above-described dispersion of polyester resin particle 1, 2,000 g of deionized water, 105 g of the colored microparticle dispersion D-1-7 and 130 g of the wax dispersion 1 were introduced into a 5 liter four-necked flask provided with a temperature sensor, a condenser, a nitrogen gas0introducing device and stirrer and stirred to prepare a mixture. After adjusting to a temperature of 30° C. an aqueous 5 mol/l sodium hydroxide solution was added to the mixture to adjust the pH to 10.0. Subsequently an aqueous solution of 52.6 g of magnesium chloride hexahydrate dissolved in 72 g of deionized water was added thereto over a period of 10 at 30° C. with stirring. The, after allowed to stand for 3 min., the temperature was raised to 90° C. in 6 min. (at a temperature-raising rate of 10° C./min). While measuring the particle size in COULTER COUNTER TA-III (produced by Beckman Coulter Co.) and when reached a volume median diameter ($D_{50}$) of 6.5 μm an aqueous solution of 115 g of sodium chloride dissolved in 700 g of deionized water was added thereto to stop growth of particles. The solution temperature was further maintained at 90±2° C. and stirring continued for 6 hr. to allow particles to be fused. Then, the reaction mixture was cooled to 30° C. at a rate of 6° C./min and hydrochloric acid was added thereto to adjust the pH and stirring was stopped. The thus formed toner particles were separated through solid/liquid separation and washing with deionized water was repeated four times (in an amount of 15 liters of deionized water). Thereafter, drying was carried out by hot air at 40° C. to obtain toner particles. The thus obtained toner particles were designated as toner particle 1-7.

Preparation of Toner Particles 1-8 to 1-12:

Toner particles 1-8 to 1-12 were each prepared similarly to the foregoing toner particle 1-1, except that the colored microparticle dispersion D-1-1 was replaced by each of the colored microparticle dispersions D-1-8 to D-1-12.

Preparation of Toner Particles 1-13 and 1-14:

Toner particles 1-13 and 1-14 were each prepared similarly to the foregoing toner particle 1-1, except that the polyester resin particle 1 was replaced by the polyester resin particle 2 or 3.

Preparation of Toner Particles 1-15 and 1-16:

Toner particles 1-15 and 1-16 were each prepared similarly to the foregoing toner particle 1-1, except that the wax dispersion 1 was replaced by the wax dispersion 2 or 3.

External Additive Treatment:

To each of the thus prepared toner particles 1-1 to 1-16 were added 1% by weight of hydrophobic silica (exhibiting a volume median diameter of 12 nm and a hydrophobicity of 68) and 1% by weight of hydrophobic titanium oxide (exhibiting a volume median diameter of 20 nm and a hydrophobicity of 63) and mixed by using HENSCHEL MIXER. Subsequently, coarse particles ere removed by using a sieve having a mesh of 45 μm to obtain toners 1-1 to 1-16.

In Table 1 are shown colorants and resins used in colored microparticles, colorant contents (which is represented by a weight ratio of colorant to resin, i.e., colorant/resin) and the volume median diameters of colored microparticles D-1-1 to D-1-12.

TABLE 1

| Colored Microparticle | Colorant | Resin | Colorant/ Resin (wt %) | Volume Median Diameter (nm) |
|---|---|---|---|---|
| D-1-1 | SB-94*1 | crosslinked PE*5 | 55 | 44 |
| D-1-2 | SB-94 | crosslinked PE | 55 | 53 |
| D-1-3 | (A-1)*2 | crosslinked PE | 55 | 55 |
| D-1-4 | SY-16*3 | crosslinked PE | 55 | 57 |
| D-1-5 | SB-94 | crosslinked PE | 15 | 60 |
| D-1-6 | SB-94 | crosslinked PE | 5 | 80 |
| D-1-7 | SB-94 | crosslinked PE | 85 | 52 |
| D-1-8 | SB-94 | noncrosslinked PE*6 | 55 | 42 |
| D-1-9 | (A-1) | noncrosslinked PE | 55 | 53 |
| D-1-10 | SB-94 | crosslinked PE | 55 | 430 |
| D-1-11 | PB-15-3*4 | — | 55 | 120 |
| D-1-12 | SB-94 | St/BA*7 | 55 | 50 |

*1C.I. Solvent Blue 94
*2metal chelate dye (A-1)
*3C.I. Solvent Yellow 16
*4C.I. Pigment Blue 15-3
*5crosslinked polyester
*6non-crosslinked polyester
*7styrene/butyl acrylate Preparation of Developer:

Each of the prepared toners 1-1 to 1-16 was mixed with silicone resin-covered ferrite carrier exhibiting a volume median diameter ($D_{50}$) of 60 μm at a toner concentration of 6% by weight to prepare developers 1-1 to 1-16.

Evaluation

Evaluation was made using a commercially available multifunctional product adopting an electrophotographic system, Sitios 7165 (Konica Minolta business Technologies Inc.).

Separation of Colorant:

Separation of colorants from toner particles which occurred in the course of preparation of toners was evaluation in the manner as described below. A solution which completed fusion was subjected to centrifugal separation using centrifugal separator H-900 (produced by Kokusan Enshinki Co., Ltd.) at a rotation rate of 2,000 rpm for 2 min. and the obtained supernatant was visually evaluated with respect to coloring level, based on the following criteria:

A: no coloring of the supernatant was observed,

B: slightly coloring of the supernatant was observed,

C: coloring of the supernatant was observed.

Decomposition of Colorant:

Decomposition of a colorant, caused in the course of preparation of toners was evaluated by absorption spectrometry of the colorant before and after preparing toner particles. Absorption spectrometry was conducted using 330-type recording spectrophotometer (produced by Hitachi). Deviation of λmax in the absorption spectrum of a toluene solution of a toner from that of a toluene solution of a colorant was evaluated based on the following criteria:

A: a deviation of less than 5 nm,

B: a deviation of not less than 5 nm and less than 15 nm,

C: a deviation of not less than 15 nm.

Image Evaluation:

Used as an image evaluation apparatus was a commercially available multifunctional product adopting an electrophotographic system, Sitios 7165 (Konica Minolta Business Technologies Inc.).

Each of the foregoing toners 1-16 and developers 1-16 was charged into the image evaluation apparatus and evaluated with respect to the following items. Printer was conducted using an original image of pixel ratio of 10%; (in which each of letter images of 7%, a portrait photograph, a solid white image and a solid image accounted for ¼ part).

Transparency:

Transparency of toner images was evaluated as follows. Transparent images (OHP images) were prepared and a fixed image was measured by 330-type recording spectrophotometer (produced by Hitachi) with respect to visible spectral transmittance using an OHP sheet having no toner as a reference. The difference in spectral transmittance between 650 nm and 450 nm of a yellow toner, the difference in spectral transmittance between 650 nm and 550 nm of a magenta toner and the difference in spectral transmittance between 600 nm and 500 nm of an yellow toner were each measured, and transparency of the OHP image was evaluated based on the following criteria. Values of 70% or more were judged as superior transparency. Evaluation was made within the range of toner coverage of 0.7±0.05 (mg/cm$^2$). Preparation of a transparent image (OHP image) used a 75 μm thick polyester film.

Evaluation Criteria:

A: not less than 90%,

B: not less than 7% and less than 90%,

C: less than 70%.

Light Stability:

After measuring the density (Ci) of a toner image, the toner image was exposed to xenon light (85,00 lux) for 7 days using a weather meter Atlas Ci 165 (produced by Toyo Seiki Seisakusho) and the toner image density (Cf) was also measured. From the difference in image density between before and after being exposed to xenon light, the residual ratio of dye was calculated based on the following:

$$\text{Dye residual ratio}=[(Ci—Cf)/Ci]\times 100(\%)$$

Light stability was evaluated based on the following criteria:

A: a dye residual ratio of not less than 90% and superior light stability,

B: a dye residual ratio of less than 90% and not less than 80%, and good light stability, C: a dye residual ratio of less than 80% and inferior light stability.

Image Density:

Image density was measured using a reflection densitometer, X-Rite 310TR (produced by X-Rite Co.). Fine-quality paper (64 g/m$^2$) was used in preparation of toner images. The image density was evaluated on the following criteria:

A: a density of 1.5 or more and superior image density,

B: a density of not less than 1.3 and less than 1.5, good image density,

C: a density of less than 1.3 and inferior image density.

Evaluation results are shown in Table 2.

TABLE 2

| Example No. | Toner No. | Colored Microparticle | Separation of Colorant | Decomposition of Colorant | Transparency | Light Stability | Image Density |
|---|---|---|---|---|---|---|---|
| 1-1 | 1-1 | D-1-1 | A | A | B | A | A |
| 1-2 | 1-2 | D-1-2 | A | A | B | A | A |
| 1-3 | 1-3 | D-1-3 | A | A | B | A | A |
| 1-4 | 1-4 | D-1-4 | A | A | A | A | A |
| 1-5 | 1-5 | D-1-5 | A | A | A | A | A |
| 1-6 | 1-6 | D-1-1 | A | A | B | A | A |
| 1-7 | 1-13 | D-1-1 | A | A | B | A | A |
| 1-8 | 1-14 | D-1-1 | A | A | B | A | A |
| 1-9 | 1-15 | D-1-1 | A | A | B | A | A |
| 1-10 | 1-16 | D-1-6 | A | A | A | B | B |
| 1-11 | 1-7 | D-1-7 | B | A | B | A | A |
| 1-12 | 1-10 | D-1-10 | B | B | B | A | A |
| Comp. 1-1 | 1-8 | D-1-8 | C | B | B | C | A |
| Comp. 1-2 | 1-9 | D-1-9 | C | B | A | C | A |
| Comp. 1-3 | 1-11 | D-1-11 | C | C | C | B | A |
| Comp. 1-4 | 1-12 | D-1-12 | C | A | B | B | A |

As apparent from Table 2, it was proved that toners 1-1 to 1-7, 1-10 aid 1-13 to 1-16 according to the invention, used in Examples 1-1 to 1-12 were superior in any of evaluation items. It was also proved that toners 1-8, 1-9, 1-11 and 1-12, used in comparative examples 1-1 to 1-4 were inferior and having a problem in at least one item of evaluation.

Example 2

Preparation of Polyester Resin Particles

Polyester resin particles 1-3 were each prepared similarly to polyester resin particles 1-3.

Preparation of Colored Microparticle Dispersion Colored Microparticle Dispersion D-2-1:

Into a separable flask, 54 g of C.I. Solvent Blue 94, 360 g of ethyl acetate and 30 g of isophorone diisocyanate were added and completely dissolved with stirring to obtain solution. The thus obtained solution was added to an aqueous surfactant solution of 27 g of sodium dodecylsulfate dissolved in 780 g of water and dispersed using an ultrasonic dispersing machine. Thereafter, ethyl acetate was removed under reduced pressure at 40° C. To this dispersion, 18 g of ethylene glycol was added and heated to 60° C. with stirring to perform reaction to prepare a dispersion of colored microparticles containing polyurethane resin and a colorant. The thus prepared dispersion of colored microparticles was designated as colored microparticle dispersion D-2-1. The colored microparticles exhibited a volume median diameter of 45 nm.

Colored Microparticle Dispersion D-2-2:

A dispersion of colored microparticles was prepared similarly to the foregoing colored microparticle dispersion D-2-1, except that ethylene glycol was replace by hexamethylene glycol. The thus prepared dispersion of colored microparticles was designated as colored microparticle dispersion D-2-2. The colored microparticles exhibited a volume median diameter of 52 nm.

Colored Microparticle Dispersion D-2-3:

Into a separable flask, 54 g of C.I. Solvent Blue 94 and 360 g of ethyl acetate were added and completely dissolved with stirring to obtain solution. The thus obtained solution was added to an aqueous surfactant solution of 27 g of sodium dodecylsulfate dissolved in 780 g of water and dispersed using an ultrasonic dispersing machine. Thereafter, ethyl acetate was removed under reduced pressure at 40° C. to obtain a colorant dispersion.

Subsequently, to the foregoing colorant dispersion was added 49 g of melamine/formaldehyde resin prepolymer which was obtained by 1 mole of melamine resin in 3 mmoles of formaldehyde (37% aqueous solution, adjusted to a pH of 8-9 with an aqueous 10% sodium carbonate solution) and stirred at 80° C. for 2 hr. to prepare a dispersion of colored microparticles containing melamine resin and a colorant. The thus prepared dispersion of colored microparticles was designated as colored microparticle dispersion D-2-3. The colored microparticles exhibited a volume median diameter of 48 nm.

Colored Microparticle Dispersion D-2-4:

A dispersion of colored microparticles was prepared similarly to the foregoing colored microparticle dispersion D-2-1, except that C.I. Solvent Blue 94 was replaced by metal chelate dye (A-1) used in Example 1. The thus prepared dispersion of colored microparticles was designated as colored microparticle dispersion D-2-4. The colored microparticles exhibited a volume median diameter of 57 nm.

Colored Microparticle Dispersion D-2-5

A dispersion of colored microparticles was prepared similarly to the foregoing colored microparticle dispersion D-2-1, except that C.I. Solvent Blue 94 was replaced by C.I. Solvent Yellow 16. The thus prepared dispersion of colored microparticles was designated as colored microparticle dispersion D-2-5. The colored microparticles exhibited a volume median diameter of 63 nm.

Colored Microparticle Dispersion D-2-6:

Similarly to the colored microparticle dispersion D-2-1, 54 g of C.I. Solvent Blue 94, 360 g of ethyl acetate and 56 g of isophorone diisocyanate were added into a separable flask and completely dissolved with stirring to obtain solution. The thus obtained solution was added to an aqueous surfactant solution of 27 g of sodium dodecylsulfate dissolved in min 780 g of water and dispersed using an ultrasonic dispersing machine. Thereafter, ethyl acetate was removed under reduced pressure at 40° C. to obtain a dispersion.

To this dispersion, 34 g of ethylene glycol was added and heated to 60° C. with stirring to perform reaction to prepare a dispersion of colored microparticles containing polyurethane resin and a colorant. The thus prepared dispersion of colored microparticles was designated as colored microparticle dispersion D-2-6. The colored microparticles exhibited a volume median diameter of 83 nm.

Colored Microparticle Dispersion D-2-7:

Similarly to the colored microparticle dispersion D-2-1, 5 g of C.I. Solvent Blue 94, 360 g of ethyl acetate and 56 g of isophorone diisocyanate were added into a separable flask and completely dissolved with stirring to obtain solution. The thus obtained solution was added to an aqueous surfactant solution of 27 g of sodium dodecylsulfate dissolved in 780 g of water and dispersed using an ultrasonic dispersing machine. Thereafter, ethyl acetate was removed under reduced pressure at 40° C. to obtain a dispersion.

To this dispersion, 34 g of ethylene glycol was added and heated to 60° C. with stirring to perform reaction to prepare a dispersion of colored microparticles containing polyurethane resin and a colorant. The thus prepared dispersion of colored microparticles was designated as colored microparticle dispersion D-2-7. The colored microparticles exhibited a volume median diameter of 80 mm.

Colored Microparticle Dispersion D-2-8:

Similarly to the colored microparticle dispersion D-2-1, 84 g of C.I. Solvent Blue 974, 360 g of ethyl acetate and 10 g of isophorone diisocyanate were added into a separable flask and completely dissolved with stirring to obtain solution. The thus obtained solution was added to an aqueous surfactant solution of 27 g of sodium dodecylsulfate dissolved in 780 g of water and dispersed using an ultrasonic dispersing machine. Thereafter, ethyl acetate was removed under reduced pressure at 40° C. to obtain a dispersion.

To this dispersion, 6 g of ethylene glycol was added and heated to 60° C. with stirring to perform reaction to prepare a dispersion of colored microparticles containing polyurethane resin and a colorant. The thus prepared dispersion of colored microparticles was designated as colored microparticle dispersion D-2-8. The colored microparticles exhibited a volume median diameter of 53 nm.

Colored Microparticle Dispersion D-2-9:

A dispersion of colored microparticles was prepared similarly to the foregoing colored microparticle dispersion D-2-1, except that 30 g of isophorone diisocyanate was replaced by 45 g of styrene/butyl acrylate resin (80/20 by weight, weight-average molecular weight of 20,000). The thus prepared dispension of colored microparticles was designated as colored microparticle dispersion D-2-9. The colored microparticles exhibited a volume median diameter of 42 nm.

Colored Microparticle Dispersion D-2-10:

A dispersion of colored microparticles was prepared similarly to the foregoing colored microparticle dispersion D-2-9, except that C.I. Solvent Blue 94 was replaced by metal chelate dye (A-1) used in Example 1. The thus prepared dispersion of colored microparticles was designated as colored microparticle dispersion D-2-10. The colored microparticles exhibited a volume median diameter of 53 mm.

Colored Microparticle Dispersion D-2-11:

A dispersion of colored microparticles was prepared similarly to the foregoing colored microparticle dispersion D-2-1, except that sodium dodecylbenzenesulfonate was changed from 27 g to 4 g. The thus prepared dispersion of colored microparticles was designated as colored microparticle dispersion D-2-11. The colored microparticles exhibited a volume median diameter of 430 nm.

Colored Microparticle Dispersion D-2-12:

90 g of sodium n-dodecylbenzenesulfonate was added to 1 liter of pure water and stirred. To this solution, 1.20 g of C.I. Pigment Blue 15-3 was gradually added and stirred for 1 hr. Then, the mixture was continuously dispersed over 20 hr. using a sand grinder (medium-type dispersing machine) to prepare a dispersion of colored microparticles. The thus prepared dispersion of colored microparticles was designated as colored microparticle dispersion D-2-12. The colored microparticles exhibited a volume median diameter of 120 nm.

Preparation of Toner

Toner Particle 2-1:

1400 g of the above-described dispersion of polyester resin particle 1 used in Example 1, 2,000 g of deionized water, 165 g of the colored microparticle dispersion D-2-1 and 125 g of the wax dispersion 1 used in Example 1 were introduced into a 5 liter four-necked flask provided with a temperature sensor, a condenser, a nitrogen gas0introducing device and stirrer and stirred to prepare a mixture. After adjusting to a temperature of 30° C., an aqueous 5 mol/l sodium hydroxide solution was added to the mixture to adjust the pH to 10.0. Subsequently, an aqueous solution of 52.6 g of magnesium chloride hexahydrate dissolved in 72 g of deionized water was added thereto over a period of 10 at 30° C. with stirring. The, after allowed to stand for 3 min., the temperature was raised to 90° C. in 6 min. (at a temperature-raising rate of 10° C./min). While measuring the particle size in COULTER COUNTER TA-III (produced by Beckman Coulter Co.) and when reached a volume median diameter ($D_{50}$) of 6.5 μm, and aqueous solution of 115 g of sodium chloride dissolved in 700 g of deionized water was added thereto to stop growth of particles. The solution temperature was further maintained a 90±2° C. and stirring continued for 6 hr. to allow particles to be fused. Then, the reaction mixture was cooled to 30° C. at a rate of 6° C./min and hydrochloric acid was added thereto to adjust the pH and stirring was stopped. The thus formed toner particles were separated through solid/liquid separation and washing with deionized water was repeated four times (in an amount of 15 liters of deionized water). Thereafter, drying was carried out by hot air at 40° C. to obtain toner particles. The thus obtained toner particles were designated as toner particle 2-1.

Toner Particles 2-2 to 2-5:

Toner particles 2-2 to 2-5 were each prepared similarly to the foregoing toner particle 2-1, except that the colored microparticle dispersion D-2-1 was replaced by each of the colored microparticle dispersions D-2-2 to D-2-5.

Toner Particle 2-6:

1100 g of the above-described dispersion of polyester resin particle 1, 2,000 g of deionized water, 595 g of the colored microparticle dispersion D-2-6 and 100 g of the wax dispersion 1 were introduced into a 5 liter four-necked flask provided with a temperature sensor, a condenser, a nitrogen gas0introducing device and stirrer and stirred to prepare a mixture. After adjusting to a temperature of 30° C., an aqueous 5 mol/l, sodium hydroxide solution was added to the mixture to adjust the pH to 10.0. Subsequently, an aqueous solution of 52.6 g of magnesium chloride hexahydrate dissolved in 72 g of deionized water was added thereto over a period of 10 at 30° C. with stirring. The, after allowed to stand for 3 min., the temperature was raised to 90° C. in 6 min. (at a temperature-raising rate of 10° C./mine). While measuring the particle size in COULTER COUNTER TA-III (produced by Beckman Coulter Co.) and when reached a volume median diameter ($D_{50}$) of 6.5 μm, an aqueous solution of 115 g of sodium chloride dissolved in 700 g of deionized water was added thereto to stop growth of particles. The solution temperature was further maintained at 90±2° C. and stirring continued for 6 hr. to allow particles to be fused. Then, the reaction mixture was cooled to 30° C. at a rate of 6° C./min and hydrochloric acid was added thereto to adjust the pH and stirring was stopped. The thus formed toner particles were separated through solid/liquid separation and washing with deionized water was repeated four times (in an amount of 15 liters of deionized water). Thereafter, drying was carried out by hot air at 40° C. to obtain toner particles. The thus obtained toner particles were designated as toner particle 2-6.

Preparation of Toner Particle 2-7:

Toner particle 2-7 was prepared similarly to the foregoing toner particle 2-6, except that the colored microparticle dispersion D-2-6 was replaced by the colored microparticle dispersions D-2-7.

Preparation of Toner Particle 2-8:

185 g of the above-described dispersion of polyester resin particle 1, 2,000 g of deionized water, 105 g of the colored microparticle dispersion D-2-8 and 130 g of the wax dispersion 1 were introduced into a 5 liter four-necked flask provided with a temperature sensor, a condenser, a nitrogen gas0introducing device and stirrer and stirred to prepare a mixture. After adjusting to a temperature of 30° C., an aqueous 5 mol/l sodium hydroxide solution was added to the mixture to adjust the pH to 10.0. Subsequently, and aqueous solution of 52.6 g of magnesium chloride hexahydrate dissolved in 72 g of deionized water was added thereto over a period of 10 at 30° C. with stirring. The, after allowed to stand for 3 min., the temperature was raised to 90° C. in 6 min. (at a temperature-raising rate of 10° C./min). While measuring the particle size in Coulter counter TA-III (produced by Beckman Coulter Co.) and when reached a volume median diameter ($D_{50}$) of 6.5 μm, an aqueous solution of 115 g of sodium chloride dissolved in 700 g of deionized water was added thereto to stop growth of particles. The solution temperature was further maintained at 90±2° C. and stirring continued for 6 hr. to allow particles to be fused. Then, the reaction mixture was cooled to 30° C. at a rate of 6° C./min and hydrochloric acid was added thereto to adjust the pH and stirring was stopped. The thus formed toner particles were separated through solid/liquid separation and washing with deionized water was repeated four times (in and amount of 15 liters of deionized water). Thereafter, drying was carried out by hot air at 40° C. to obtain toner particles The thus obtained toner particles were designated as toner particle 2-8.

Preparation of Toner Particles 2-9 to 2-12:

Toner particles 2-9 to 2-12 were each prepared similarly to the foregoing toner particle 2-1, except that the colored microparticle dispersion D-2-1 was replaced by each of the colored microparticle dispersions D-2-9 to D-2-12.

Preparation of Toner Particles 2-13 and 2-14:

Toner particles 2-13 and 2-14 were each prepared similarly to the foregoing toner particle 2-1, except that the polyester resin particle 1 was replaced by the polyester resin particle 2 or 3 used in Example 1.

Preparation of Toner Particles 2-15 and 2-16:

Toner particles 2-15 and 2-16 were each prepared similarly to the foregoing toner particle 1-1, except that the wax dispersion 1 was replaced by the wax dispersion 2 or 3 used in Example 1.

External Additive Treatment:

To each of the thus prepared toner particles 2-1 to 2-16 were added 1% by weight of hydrophobic silica (exhibiting a volume median diameter of 12 nm and a hydrophobicity of 68) and 1% by weight of hydrophobic titanium oxide (exhibiting a volume median diameter of 20 nm and a hydrophobicity of 63) and mixed by using Henschel mixer. Subsequently, coarse particles ere removed by using a sieve having a mesh of 45 μm to obtain toners 2-1 to 2-16.

In Table 3 are shown colorants and resins used for colored microparticles, and the volume median diameters of colored microparticles D-2-1 to D-2-12.

TABLE 3

| Colored Microparticle | Colorant | Resin | Colorant/ Resin (wt %) | Volume Median Diameter (nm) |
|---|---|---|---|---|
| D-2-1 | SB-94*1 | polyurethane | 55 | 45 |
| D-2-2 | SB-94 | polyurea | 55 | 52 |
| D-2-3 | SB-94 | melamine | 55 | 48 |
| D-2-4 | (A-1)*2 | polyurethane | 55 | 57 |
| D-2-5 | SY-16*3 | polyurethane | 55 | 83 |
| D-2-6 | SB-94 | polyurethane | 15 | 83 |
| D-2-7 | SB-94 | polyurethane | 5 | 80 |
| D-2-8 | SB-94 | polyurethane | 85 | 53 |
| D-2-9 | SB-94 | St/BA*5 | 55 | 42 |
| D-2-10 | (A-1) | St/BA | 55 | 53 |
| D-2-11 | SB-94 | polyurethane | 55 | 430 |
| D-2-12 | PB-15-3*4 | — | 55 | 120 |

*1C.I. Solvent Blue 94
*2metal chelate dye (A-1)
*3C.I. Solvent Yellow 16
*4C.I. Pigment Blue 15-3
*5styrene/butyl acrylate Preparation of Developer:

Each of the prepared toners 2-1 to 2-16 was mixed with silicone resin-covered ferrite carrier exhibiting a volume median diameter ($D_{50}$) of 60 μm at a toner concentration of 6% by weight to prepare developers 2-1 to 2-16.

Evaluation

Evaluation was made similarly to Example 1.

Evaluation results are shown in Table 4

TABLE 4

| Example No. | Toner No. | Colored Microparticle | Separation of Colorant | Decomposition of Colorant | Transparency | Light Stability | Image Density |
|---|---|---|---|---|---|---|---|
| 2-1 | 2-1 | D-2-1 | A | A | B | A | A |
| 2-2 | 2-2 | D-2-2 | A | A | B | A | A |
| 2-3 | 2-3 | D-2-3 | A | A | B | A | A |
| 2-4 | 2-4 | D-2-4 | A | A | A | A | A |
| 2-5 | 2-5 | D-2-5 | A | A | A | A | A |
| 2-6 | 2-6 | D-2-6 | A | A | B | A | A |
| 2-7 | 2-13 | D-2-1 | A | A | B | A | A |
| 2-8 | 2-14 | D-2-1 | A | A | B | A | A |
| 2-9 | 2-15 | D-2-1 | A | A | B | A | A |
| 2-10 | 2-16 | D-2-1 | A | A | B | A | A |
| 2-11 | 2-7 | D-2-7 | A | A | A | A | B |
| 2-12 | 2-8 | D-2-8 | B | A | B | A | A |
| 2-13 | 2-11 | D-2-11 | B | B | B | B | A |
| Comp. 2-1 | 2-9 | D-2-9 | C | B | B | C | A |
| Comp. 2-2 | 2-10 | D-2-10 | C | B | A | C | A |
| Comp. 2-3 | 2-12 | D-2-12 | A | — | C | A | A |

As apparent from Table 4, it was proved that toners 2-1 to 2-8, 2-11 and 2-13 to 2-16 according to the invention, used in Examples 2-1 to 2-13 were superior in any of evaluation items. It was also proved that toners 2-9, 2-10 and 2-12, used in Comparative Examples 2-1 to 2-3 were inferior and having a problem in at least one item of evaluation.

What is claimed is:

1. A method of preparing an electrophotographic toner comprising:

subjecting polyester resin particles and colored microparticles to coagulation and fusion in an aqueous medium to form toner particles, wherein the colored microparticles comprise a colorant and a crosslinked polyester resin or a nitrogen-containing polycondensate resin.

2. The method of claim 1, wherein the colored microparticles comprise the crosslinked polyester resin.

3. The method of claim 1, wherein the colored microparticles comprise the nitrogen-containing polycondensate resin.

4. The method of claim 1, wherein the crosslinked polyester resin is at least one selected from the group consisting of polyester resins comprising polyvalent alcohol units and polyvalent carboxylic acid units including a polyvalent carboxylic acid unit having a valence of three or more.

5. The method of claim 4, wherein the polyvalent carboxylic acid unit having a valence of three or more accounts for 10% to 30% by weight of the polyvalent carboxylic acid units.

6. The method of claim 1, wherein the nitrogen-containing polycondensate resin is at least one selected from the group consisting of a polyurethane, a polyurea, a polyamide and a melamine resin.

7. The method of claim 1, wherein the colorant comprises an oil-soluble dye.

8. The method of claim 7, wherein the oil-soluble dye exhibits a solubility in toluene of at least 0.01 g per 100 ml of toluene at 25° C.

9. The method of claim 1, wherein the colorant comprises a metal chelate dye.

10. The method of claim 9, wherein the metal chelate dye is a compound represented by the following formula (1):

$$M(Dye)_n(A)_m \qquad \text{formula (1)}$$

wherein M represents a metal ion, Dye represents a dye capable of forming a coordinate bond to the metal ion, A represents a ligand except for the dye, n is an integer of 1, 2 and 3, and m is an integer of 0, 1, 2 and 3, provided that when m is 0, n is 2 or 3.

11. The method of claim 1, wherein the colored microparticles exhibit a volume median diameter of 10 to 300 nm.

12. The method of claim 1, wherein the colorant is contained in the colored microparticles in an amount of 10% to 70% by weight, based on the crosslinked polyester resin or the nitrogen-containing polycondensate resin.

13. The method of claim 1, wherein the polyester resin particles are prepared by a process comprising:

dispersing a polymerizable composition comprising a polyvalent carboxylic acid and a polyvalent alcohol in an aqueous medium and subjecting the polyvalent carboxylic acid and the polyvalent alcohol to polycondensation to form the polyester resin particles.

14. The method of claim 13, wherein the aqueous medium contains a surfactant containing an acidic group.

15. The method of claim 14, wherein the acidic group is selected from the group consisting of a sulfonic acid group, a carboxylic acid group and a phosphoric acid group.

16. The method of claim 13, wherein the polymerizable composition is dispersed in the form of oil-droplets in the aqueous medium.

17. The method of claim 1, wherein the polyester resin particles and the colored microparticles are subjected to coagulation by adding a coagulant to the aqueous medium to form coagulated particles and the coagulated particles are subjected to fusion by maintaining the coagulated particles at a temperature higher than the glass transition temperature of the polyester resin particles.

18. The method of claim 17, wherein the coagulated particles are heated up to the temperature higher than the glass transition temperature of the polyester resin particles at a heating rate of 1 to 15° C./min.

19. The method of claim 1, wherein the polyester resin particles exhibit a glass transition temperature of 20 to 90° C.

20. The method of claim 1, wherein the polyester resin particles exhibit a weight average molecular weight of not less than 10,000 and a number average molecular weight of not more than 20,000.

* * * * *